US006194134B1

(12) United States Patent
Matsunaga et al.

(10) Patent No.: US 6,194,134 B1
(45) Date of Patent: Feb. 27, 2001

(54) INTERNAL LATENT IMAGE-TYPE DIRECT POSITIVE SILVER HALIDE PHOTOGRAPHIC EMULSION AND COLOR DIFFUSION TRANSFER LIGHT-SENSITIVE MATERIAL USING THE SAME

(75) Inventors: Atsushi Matsunaga; Takefumi Hara, both of Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/405,001

(22) Filed: Sep. 27, 1999

(30) Foreign Application Priority Data

Sep. 29, 1998 (JP) ..... 10-275741

(51) Int. Cl.[7] ..... G03C 1/035
(52) U.S. Cl. ..... 430/567
(58) Field of Search ..... 430/567

(56) References Cited

U.S. PATENT DOCUMENTS 5,156,946 * 10/1992 Nagaoka et al. ..... 430/567
5,206,134 4/1993 Yamada et al. ..... 430/569

* cited by examiner

*Primary Examiner*—Hoa Van Le
(74) *Attorney, Agent, or Firm*—Sughrue, Mion, Zinn, Macpeak & Seas, PLLC

(57) ABSTRACT

An internal latent image-type direct positive silver halide photographic emulsion is disclosed, comprising a silver halide grain prepared to have a composite structure such that the iodide content of the silver halide in the silver halide phase formed on the surface of a silver halide grain is higher than the iodide content of the silver halide in the phase on the inner side, wherein the average iodide content of all grains is less than 1.0 mol % and the amount of iodide supplied for the silver halide phase formed on the surface of the grain is from 0.005 mol % to less than 0.3 mol % based on all grains. Also disclosed is a color diffusion transfer light-sensitive material using the emulsion.

3 Claims, No Drawings

INTERNAL LATENT IMAGE-TYPE DIRECT POSITIVE SILVER HALIDE PHOTOGRAPHIC EMULSION AND COLOR DIFFUSION TRANSFER LIGHT-SENSITIVE MATERIAL USING THE SAME

FIELD OF THE INVENTION

The present invention relates to an internal latent image-type direct positive silver halide photographic emulsion and a color diffusion transfer light-sensitive material using the emulsion.

BACKGROUND OF THE INVENTION

The photograph using silver halide has been heretofore widely used because of its excellent sensitivity and gradation as compared with those obtained by other photographic processes such as electrophotographic process and diazo photographic process. In this connection, a method of directly forming a positive image is known. According to this method, as described, for example, in U.S. Pat. No. 3,761,276 and JP-B-60-55821 (the term "JP-B" as used herein means an "examined Japanese patent publication"), an internal latent image-type direct positive silver halide photographic emulsion is used and a silver halide grain having formed in the inside thereof a latent image is developed with a surface developer (developer which substantially does not develop but leaves the latent image formed site inside the silver halide grain) while uniformly applying exposure or using a nucleating agent to obtain a positive image.

Conventionally, it is known that the microstructure of the silver halide crystal has an effect on the final photographic performance. Duffin, *Photographic Emulsion Chemistry,* p. 18, The Focal Press (1966) states that "In the case of silver iodobromide emulsion, an important factor to take account of is the position of iodide. The iodide can present mainly in the center of the crystal, can be distributed over the entire grain or can be present mainly on the outer surface. The actual position of the iodide is determined by the preparation conditions and the position apparently has an effect on the physical and chemical properties of the crystal."

In the so-called single jet method where iodide and bromide salts each in the whole amount are allowed to be present in a reaction vessel and an aqueous silver salt solution is introduced into the reaction vessel to produce silver iodobromide grains, silver iodide first precipitates, therefore, silver iodide is liable to concentrate in the center of the grain. On the other hand, in the double jet method where iodide and bromide salts both are simultaneously introduced together with silver salt into the reaction vessel, the distribution of silver iodide within the grain can be intentionally controlled. For example, silver iodide may be uniformly distributed throughout the grain or when the addition of bromide salt is reduced or stopped on the way of grain formation and the addition of iodide salt is continued, a silver iodide or a silver iodobromide shell having a high silver iodide content can be formed on the outer surface (outer side) of the grain. JP-A-58-113927 (the term "JP-A" as used herein means an "unexamined published Japanese patent application") discloses a silver halide emulsion in which at least 50% of the entire projected area is occupied by silver iodobromide tabular grains having a thickness of less than 0.5 $\mu$m, a diameter of 0.6 $\mu$m or more and an average aspect ratio of 8:1 or more, the tabular grain has first and second opposing parallel main surfaces, and the emulsion contains tabular silver iodobromide such that a central region extending between these two main surfaces and the silver iodide content in the central region is lower than the iodide content in the region also extending between the two main surfaces but being displaced in at least one transverse direction. JP-A-59-99433 discloses a silver halide emulsion in which 10% (by number) or more of silver halide grains present in the silver halide emulsion are silver halide tabular grains having an aspect ratio of 5 or more, the emulsion contains a silver halide grain such that silver iodide is contained in the portion inner than the area having a silver amount of 80 mol % based on the silver amount of the entire grain, from the center part in the long or short axis direction of the grain (inner high iodide phase), the average iodide content in the inner high iodide phase is 5 times or more the average iodide content of the silver halide present on the outer side than the inner high iodide phase, and the silver amount of the inner high iodide phase is 50 mol % or less of the silver amount of the entire grain. Furthermore, JP-A-60-147727 discloses a silver halide photographic emulsion containing silver halide grains each having a multi-layer structure and an aspect ratio of 5 or less, in which the difference in the average iodide content between any two adjacent layers of the grain, each layer having a homogeneous iodide distribution, is 10 mol % or less and the total iodide content of the silver halide grain having a multi-layer structure is 20 mol % or less.

JP-A-60-14331 discloses a silver halide photographic emulsion containing silver halide grains each having a clear layer structure, in which the grain consists of a core part having a silver iodide content of from 10 to 45 mol % and a shell part having a silver iodide content of 5 mol % or less, and the grain has an average silver iodide content of 7 mol % or more. JP-A-61-245151 discloses a silver halide emulsion characterized in that the silver halide grain comprises a plurality of layers different in the silver iodide content, the outermost shell has a silver iodide content of 10 mol % or less, a high silver iodide content shell having a silver iodide content 6 mol % or more higher than that of the outermost shell is provided on the side inner than the outermost shell, and an intermediate shell having a medium silver iodide content is provided between the outermost shell and the high silver iodide content shell. According to the techniques described in these patent publications, the silver iodide content is varied depending on the position of individual grains (particularly between the inner side and the outer side of a grain) to thereby obtain good photographic properties.

Y. T. Tan and R. C. Baetzold submitted a report at the 41st Meeting of SPSE, where the energy state of silver halide is calculated and it is estimated that iodide in a silver iodobromide crystal grain has a tendency to form a cluster. In the above-described silver iodobromide tabular grains, the distribution of silver iodide is a change in the silver iodide content by the difference in the unit of at least from 300 to 1,000 Å, however, as estimated by Y. T. Tan and R. C. Baetzold, the silver iodobromide crystal is verified to have more microscopic inhomogeneous silver iodide distribution.

JP-A-4-107442 (corresponding to U.S. Pat. No. 5,206,134) discloses a method for producing a silver halide emulsion containing silver halide grains each controlled such that the iodide content on the surface of the silver halide grain is higher than the iodide content of a layer on the inner side, the grain having an iodide content of less than 1.0 mol % on average based on the entire grain, where in the formation of the grain surface, iodide is supplied in an amount of from 0.005 mol % to less than 0.3 mol % based on all silver halide grains by either (a) a method of simultaneously adding a silver nitrate solution and an iodide ion-containing solution or (b) a method of adding fine grain silver halide having an AgI and/or AgBrI composition so that the iodide content on the grain surface can be higher than that of the inner layer.

This technique has succeeded in obtaining a silver halide photographic emulsion having remarkably excellent development progressing property, superior sensitivity/fog ratio and high covering power for the tabular grain emulsion where particularly tabular grains have the same projected area diameter and the same thickness. However, the patent publication neither refers to an internal latent image-type direct positive silver halide emulsion nor teaches the effect thereof at all.

SUMMARY OF THE INVENTION

An object of the present invention is to provide an internal latent image-type direct positive silver halide photographic emulsion having high sensitivity and giving high contrast in the low density area on the reversal characteristic curve.

Another object of the present invention is to provide a color diffusion transfer light-sensitive material using the emulsion.

These objects of the present invention can be attained by the inner latent image-type direct positive silver halide emulsion in (1), (2) and (3) below and the color diffusion transfer light-sensitive material in (4) below.

(1) An internal latent image-type direct positive silver halide photographic emulsion, comprising a silver halide grain prepared to have a composite structure such that the iodide content of the silver halide in the silver halide phase formed on the surface of a silver halide grain is higher than the iodide content of the silver halide in the phase on the inner side, wherein the average iodide content of all grains is less than 1.0 mol % and the amount of iodide supplied for the silver halide phase formed on the surface of the grain is from 0.005 mol % to less than 0.3 mol % based on all grains.

(2) The internal latent image-type direct positive silver halide photographic emulsion as described in (1) above, wherein the iodide for the silver halide phase formed on the surface of the grain is supplied by the simultaneous addition of a silver nitrate solution and an iodide ion-containing solution or by the addition of fine grain silver halide comprising silver iodide and/or silver iodobromide.

(3) The internal latent image-type direct positive silver halide photographic emulsion as described in (1) or (2), wherein 50% or more of all silver halide grains are occupied by silver halide tabular grains which are the silver halide grain having a composite structure and which have an average grain diameter of 0.3 $\mu$m or more and a ratio of average grain diameter/average grain thickness of 2 or more.

(4) A color diffusion transfer light-sensitive material comprising a support having thereon at least one light-sensitive silver halide emulsion layer associated with a dye image-forming substance, the dye image-forming substance being a compound represented by the following formula (I) which is a non-diffusive compound capable of releasing a diffusive dye or a precursor thereof in connection with the silver development or a compound capable of varying in the diffusibility of the compound itself, wherein at least one layer of the silver halide emulsion layers contains the internal latent image-type direct positive silver halide emulsion described in any one of (1) to (3):

$$(\text{DYE–Y})_n\text{–Z} \qquad \text{(I)}$$

wherein DYE represents a dye group, a dye group temporarily shifted to the short wave or a dye precursor group, Y represents a mere bond or a linking group, Z represents a group having capability of releasing a diffusive dye or a precursor thereof in connection with the silver development or differentiating the diffusibility of the compound represented by $(\text{DYE–Y})_n$–Z, n represents 1 or 2, and when n is 2, two DYE–Y moieties may be the same or different.

DETAILED DESCRIPTION OF THE INVENTION

The present invention is described in detail below.

For determining the silver halide composition distribution of a silver halide emulsion grain, a powder X-ray diffraction method described, for example, in JP-A-56-110926 has been used, however, according to this method, the halogen composition distribution among grains and the halogen composition distribution within a grain cannot be principally distinguished. Therefore, when the halogen composition of silver halide emulsion grains is analyzed only by the powder X-ray diffraction method, it is difficult to systematically obtain a guideline for designing an emulsion specified in the halogen composition distribution among silver halide emulsion grains. The present inventors have examined the halogen composition of individual emulsion grains in the silver halide emulsion using various methods described below.

The silver iodide content of individual emulsion grains can be determined by analyzing the composition of silver halide grains one by one using, for example, an X-ray microanalyzer. The term "coefficient of variation in the silver iodide content of individual grains" as used herein means a value obtained in such a manner that a standard deviation of the silver iodide content obtained in the measurement of at least 100 emulsion grains on the silver iodide content is divided by the average silver iodide content and the resulting value is multiplied by 100.

*J. Soc. Photogr. Sci. Technolo. Japan,* Vol. 53, No. 2, pp. 125–128 (1990) reports the results when silver halide grains are measured one by one on the silver iodide content in the internal structure using an analytical electron microscope.

*JOURNAL OF IMAGING SCIENCE,* Vol. 31, No. 1, pp. 15–26 (1987) reports in detail on the means for observing the microstructure within the grain with regard to the halogen composition of a tabular grain using a low temperature luminescence microscopy.

*JOURNAL OF IMAGING SCIENCE,* Vol. 32, No. 4, pp. 160–177 (1988) reports in detail on the fact that when silver chloride is deposited on silver iodobromide having a silver iodide distribution within the grain, the silver iodide directs the site where the silver chloride is deposited.

Furthermore, *J. Soc. Photogr. Sci. Technolo. Japan,* Vol. 35, No. 4, page 213 et seq. (1972) reports that inhomogeneity of the halogen composition in a grain can be viewed by directly observing the grain at a low temperature using a transmission-type electron microscope.

By using these methods, the microstructure of the silver halide composition of individual silver halide grains one by one can be observed.

The emulsion grain for use in the present invention is described below.

The silver halide photographic emulsion which can be used in the present invention can be prepared by referring to the methods described, for example, in "Emulsion Preparation and Types" of *Research Disclosure* (*RD*), No. 17643, pp. 22–23 (December, 1978), ibid., No. 18716, page 648 (November, 1979), ibid., No. 307105, pp. 863–865 (November, 1989), P. Glafkides, *Chimie et Physique*

*Photographique,* Paul Montel (1967), G. F. Duffin, *Photographic Emulsion Chemistry,* The Focal Press (1966), and V. L. Zelikman et al, *Making and Coating Photographic Emulsion,* The Focal Press (1964).

For obtaining the emulsion of the present invention, silver iodobromide or silver iodobromochloride having an average iodide content of less than 1 mol % in all final grains is preferred. In the formation of the final grain surface, iodide is preferably supplied so as to reduce the distribution as much as possible among grains with respect to the surface iodide content of individual grains.

Here, call the grain before the formation of final grain surface a base grain. The base grain may have an uniform halogen composition or may be a double or more multiple structure grain such that a high iodide phase is located in the inside or on the contrary, the iodide content on the outer side of a grain is higher than that in the inside. Among these, a double structure grain having a high iodide phase in the inside is preferred. However, all final grains after the grain surface formation is completed must have an average iodide content of less than 1 mol %, preferably less than 0.7 mol %, more preferably less than 0.5 mol %.

The method for forming the silver iodobromide phase on the grain surface is described below. In the formation of final grain surface, iodide is preferably supplied so that the surface iodide content of individual grains can have substantially no distribution among grains. As the method for forming a silver iodobromide phase on the grain surface, a so-called halogen conversion method described, for example, in British Patent 635,841 and U.S. Pat. No. 3,622,318 may be used. However, if this method is performed without any control, the surface iodide content of individual grains is obliged to have a great distribution among grains and the effect of the present invention cannot be attained. The distribution among grains of the surface iodide content of individual grains is preferably such that the coefficient of variation thereof is 25% or less, more preferably 20% or less.

As the method for forming a silver iodobromide phase on the grain surface, a method of simultaneously adding a silver nitrate solution and an iodide ion-containing solution and a method of adding fine grain silver halide having an AgI and/or AgBrI composition are preferred.

In forming a silver iodobromide phase on the surface of a grain of the present invention, the average iodide content on the grain surface must be controlled to be higher than the iodide content in the inner side phase. Therefore, when a silver nitrate solution and a mixed solution of potassium iodide and potassium bromide are added or when fine grain AgBrI is added, it is necessary to adjust the composition of iodide added so as to become higher than the iodide content of the base grain. The average iodide content on the grain surface is preferably 2 times or more, more preferably 5 times or more, the iodide content of the inner side phase adjacent thereto. The average iodide content is preferably from 0.1 mol % to less than 20 mol %, more preferably from 0.2 mol % to less than 15 mol %, still more preferably from 0.5 mol % to less than 10 mol %, based on the silver halide on the grain surface formed.

In the present invention, the amount of iodide supplied at the formation of the silver iodobromide phase on the grain surface must be from 0.005 mol % to less than 0.3 mol %, preferably from 0.01 mol % to less than 0.2 mol %, more preferably from 0.02 mol % to less than 0.1 mol %, based on the silver halide grain.

In the case of adding fine grain silver halide having an AgI and/or AgBrI composition, the grain size is preferably 0.5 μm or less, more preferably 0.2 μm or less, still more preferably 0.1 μm or less.

In the present invention, a known silver halide solvent is preferably used at the time of forming the silver iodobromide phase on the grain surface. Preferred examples of the silver halide solvent include thioether compounds, thiocyanate, tetra-substituted thiourea and aqueous ammonia solution. Among these, thioether compounds and thiocyanate are particularly effective. The amount of thiocyanate used is preferably from 0.5 to 5 g per mol of silver halide and the amount of thioether compound used is preferably from 0.2 to 3 g per mol of silver halide.

The base grain for use in the present invention preferably has a grain size, in terms of the average grain size of a sphere having the same volume, of 0.3 μm or more, more preferably from 0.4 to 2.0 μm. The grain size distribution is preferably narrow.

The internal latent image-type direct positive silver halide emulsion (hereinafter sometimes simply referred to as an "internal latent image-type silver halide emulsion") of the present invention is a silver halide emulsion mainly forming a latent image in the inside of the silver halide grain. More specifically, the internal latent image-type silver halide emulsion is defined as a silver halide emulsion such that when the silver halide emulsion is coated on a transparent support in a constant amount, exposed for a fixed time of from 0.01 to 1 second and then developed with the following Developer A ("internal" developer) at 20° C. for 5 minutes, the maximum density obtained is at least 5 times larger than the maximum density obtained by developing a second sample after the same exposure with the following Developer B ("surface" developer).

The maximum density as used herein is determined by an ordinary photographic density measuring method.

Developer A

| | |
|---|---|
| N-Methyl-p-aminophenol sulfite | 2 g |
| Sodium sulfite (anhydrous) | 90 g |
| Hydroquinone | 8 g |
| Sodium carbonate (monohydrate) | 52.5 g |
| Potassium bromide | 5 g |
| Potassium iodide | 0.5 g |
| Water to make | 1 l |

Developer B

| | |
|---|---|
| N-Methyl-p-aminophenol sulfite | 2.5 g |
| 1-Ascorbic acid | 10 g |
| Potassium metanitrate | 35 g |
| Potassium bromide | 1 g |
| Water to make | 1 l |

Examples of the internal latent image-type silver halide emulsion include a conversion-type silver halide emulsion described in U.S. Pat. Nos. 2,456,953 and 2,592,250, a multi-layer structure-type silver halide emulsion different in the halogen composition between the first phase and the second phase described in U.S. Pat. No. 3,935,014, and a core/shell type silver halide emulsion obtained by covering a shell around a core grain doped with a metal ion or subjected to chemical sensitization. Among these, the core/shell type silver halide emulsion is preferred as the internal latent image-type silver halide emulsion of the present invention and examples thereof include those described in U.S. Pat. Nos. 3,206,313, 3,317,322, 3,761,266, 3,761,276, 3,850,637, 3,923,513, 4,035,185, 4,184,878, 4,395,478 and 4,504,570, JP-A-57-136641, JP-A-61-3137, JP-A-61-299155 and JP-A-62-208241.

In order to obtain a direct positive image, the internal latent image-type silver halide emulsion is imagewise exposed and before or during the subsequent development, the front surface of the exposed layer is subjected to uniform second exposure (called "light fogging method", see, for example, British Patent 1,151,363) or the silver halide emulsion is developed in the presence of a nucleating agent (called "chemical fogging method", see, for example, *Research Disclosure,* Vol. 151, No. 15162, pp. 76–78). In the present invention, the direct positive image is preferably obtained by the "chemical fogging method". The nucleating agent for use in the present invention is described below.

As described above, for obtaining a direct positive image, the internal latent image-type silver halide emulsion is imagewise exposed and before or during the subsequent development, subjected to second exposure uniformly throughout the surface or developed in the presence of a nucleating agent. Examples of the nucleating agent which can be used include hydrazines described in U.S. Pat. Nos. 2,563,785 and 2,588,982, hydrazides and hydrazones described in U.S. Pat. No. 3,227,552, heterocyclic quaternary salt compounds described in British Patent 1,283,835, JP-A-52-69613, JP-A-55-138742, JP-A-60-11837, JP-A-62-210451, JP-A-62-291637 and U.S. Pat. Nos. 3,615,515, 3,719,494, 3,734,738, 4,094,683, 4,115,122, 4,306,016 and 4,471,044, sensitizing dyes containing a substituent having a nucleation activity within the dye molecule described in U.S. Pat. No. 3,718,470, thiourea bonded acylhydrazine-based compounds described in U.S. Pat. Nos. 4,030,925, 4,031,127, 4,245,037, 4,255,511, 4,266,013 and 4,276,364 and British Patent 2,012,443, and acylhydrazine-based compounds having bonded thereto a thioamide ring or a heterocyclic group such as triazole or tetrazole, as the adsorbing group described in U.S. Pat. Nos. 4,080,270 and 4,278,748 and British Patent 2,011,391B.

The amount of the nucleating agent used is preferably such an amount as giving a sufficiently high maximum density when the internal latent image-type emulsion is developed with a surface developer. In actual use, the proper amount varies depending on the characteristics of the silver halide emulsion used, chemical structure of the nucleating agent and developing conditions and may be selected over a wide range. However, the amount useful in practice is from about 0.1 mg to 5 g, preferably from about 0.5 mg to 2 g, per mol of silver in the internal latent image-type silver halide emulsion. In the case of incorporating the nucleating agent into a hydrophilic colloid layer adjacent to an emulsion layer, the amount within the above-described range may be added based on the amount of silver contained in the internal latent image-type emulsion having the same area.

The present invention is applied to a tabular internal latent image-type direct positive silver halide emulsion. The shell as used in the present invention means a silver halide phase formed after a silver halide grain working out to the core is chemically sensitized in the process of preparing the emulsion.

The internal latent image-type silver halide emulsion of the present invention preferably has a core/shell structure as described above.

The shell may be formed by referring to JP-A-63-151618 (the Examples) and U.S. Pat. Nos. 3,206,316, 3,317,322, 3,761,276, 4,269,927 and 3,367,778. The core/shell molar ratio (weight molar ratio) is preferably from 1/30 to 5/1, more preferably from 1/20 to 2/1, still more preferably from 1/20 to 1/1.

The tabular grain may be prepared by the method described in Gutoff, *Photographic Science and Engineering,* Vol. 14, pp. 248–257 (1970), U.S. Pat. Nos. 4,434,226, 4,414,310, 4,433,048 and 4,439,520, and British Patent 2,112,157.

The method of adding silver halide grains previously formed by precipitation to the reaction vessel for preparing an emulsion described in U.S. Pat. Nos. 4,334,012, 4,301,241 and 4,150,994 is preferred in some cases. This silver halide grain may be used as a seed crystal or as silver halide for growing. In the latter case, the emulsion grain added preferably has a small grain size. The emulsion grains may be added in a whole amount at once, may be added in parts at a plurality of times or may be continuously added. Furthermore, it is also effective depending on the case to add grains having various halogen compositions so as to modify the surface.

Other than the method of adding a soluble silver salt and a halogen salt each in a constant concentration at a constant flow rate for growing the grains, a method for forming grains by changing the concentration or flow rate described in British Patent 1,469,480 and U.S. Pat. Nos. 3,650,757 and 4,242,455 is also preferred. By increasing the concentration or flow rate, the amount of silver halide supplied may be changed by the linear, secondary or more complicated function with respect to the addition time. Depending on the case, it is preferred, if desired, to reduce the amount of silver halide supplied. Furthermore, in the case where a plurality of soluble silver salts different in the solution composition are added or a plurality of soluble halogen salts different in the solution composition are added, a method of adding these by increasing one and decreasing the other is also effective.

The mixing vessel for reacting a soluble silver salt solution with a soluble halogen salt solution may be selected from the methods described in U.S. Pat. Nos. 2,996,287, 3,342,605, 3,415,650 and 3,785,777 and German Patent Publication (DOS) Nos. 2,556,885 and 2,555,364.

At the time of producing an emulsion containing tabular grains, the silver salt solution (for example, $AgNO_3$ aqueous solution) and the halide solution (for example, KBr aqueous solution) are preferably added by increasing the addition rate, addition amount and the addition concentration so as to speed up the growth of grains. This method is described, for example, in British Patent 1,335,925, U.S. Pat. Nos. 3,672,900, 3,650,757 and 4,242,445, JP-A-55-142329 and JP-A-55-158124.

At the time of preparing the emulsion of the present invention, a metal ion salt is preferably allowed to present according to the purpose, for example, during the grain formation, desalting or chemical sensitization or before the coating. By allowing a metal ion salt to be present, the amount of excess exposure for dispensing with generation of re-reversal may be increased or the minimum density may be decreased. In the case where the metal ion salt is doped to a grain, the metal ion salt is preferably added after the formation of the grain or before the completion of chemical sensitization. The metal salt ion may be doped to the entire grain, only to the core part of the grain, only to the shell part, only to the epitaxial part or only to the base grain. Examples of the metal which can be used include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. Among these, Fe, Co, Ru, Ir, Pt, Au and Pb are preferred, and Fe, Ru, Ir and Pb are more preferred.

These metals can be added as far as it is in the form of an ammonium salt, an acetate, a nitrate, a sulfate, a phosphate, a hydroxyl salt or a salt capable of dissolving the metal at the grain formation, such as 6-coordinated complex salt or 4-coordinated complex salt. Examples thereof include $CdBr_2$, $CdCl_2$,$Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $NH_4RhCl_6$ and $K_4Ru(CN)_6$. The ligand of the coordination compound can be selected from halide, $H_2O$, cyano, cyanate, nitrosyl, thionitrosyl, oxo and carbonyl. These metal compounds may be used solely or in combination of two or more.

The metal compound is preferably added after dissolving it in water or an appropriate solvent such as methanol or acetone. In order to stabilize the solution, a method of adding an aqueous hydrogen halogenide solution (e.g., HCl, HBr) or an alkali halogenide (e.g., KCl, NaCl, KBr, NaBr) may be used. If desired, an acid or an alkali may be added. The metal compound may be added to the reaction vessel either before grain formation or during grain formation. Furthermore, the metal compound may be added to a water-soluble silver salt (e.g., $AgNO_3$) or an aqueous alkali halogenide solution (e.g., NaCl, KBr, KI) and then continuously added during the formation of silver halide grains. Also, a solution may be prepared independently of the water-soluble silver salt or alkali halogenide and continuously added at an appropriate time during the grain formation. A combination of various methods is also preferred.

A method of adding a chalcogenide compound during the preparation of an emulsion described in U.S. Pat. No. 3,772,031 is also useful in some cases. Other than S, Se and Te, a cyanate, a thiocyanate, a selenocyanate, a carbonate, a phosphate or an acetate may also be allowed to be present.

These are described in U.S. Pat. Nos. 2,448,060, 2,628,167, 3,737,313 and 3,772,031, and *Research Disclosure,* Vol. 134, 13452 (June, 1975).

The form of the tabular grain may be selected from a triangle, a hexagon and a circle. An equilateral hexagon consisting of six sides having nearly the same length described in U.S. Pat. No. 4,996,137 is a preferred embodiment.

The tabular emulsion as used in the present invention means an emulsion where silver halide grains having an aspect ratio (circle-corresponding diameter of a silver halide grain/thickness of the grain) of from 2 to 100 occupy 50% (area) or more of all silver halide grains in the emulsion, preferably an emulsion where silver halide grains having an aspect ratio of 5 or more, more preferably from 5 to 8, account for 50% (area) or more, preferably 70% or more, more preferably 85% or more, of all silver halide grains in the emulsion. Incidentally, the circle-corresponding diameter of the tabular silver halide grain means a diameter of a circle corresponding to two opposing main planes running in parallel or running mostly in parallel (namely, a diameter of a circle having the same projected area as the main plain), and the thickness of the grain means the distance between the main plains. If the aspect ratio exceeds 100, the emulsion may be disadvantageously deformed or ruptured during the process until the emulsion is completed as a coated material.

The circle-corresponding diameter of the tabular grain is 0.3 $\mu$m or more, preferably from 0.3 to 10 $\mu$m, more preferably from 0.5 to 5.0 $\mu$m, still more preferably from 0.5 to 3.0 $\mu$m.

The grain thickness is less than 1.5 $\mu$m, preferably from 0.05 to 1.0 $\mu$m.

Furthermore, an emulsion having a high uniformity such that the coefficient of variation of the grain thickness is 30% or less is also preferred. In addition, a grain having a specific grain thickness and a specific plane-to-plane distance described in JP-A-63-163451 is preferred.

The diameter and the thickness of a tabular grain can be determined by an electron microphotograph of the grain according to the method described in U.S. Pat. No. 4,434,226.

The grain size of the emulsion of the present invention can be evaluated by the diameter of a circle having the projected area determined using an electron microscope, the diameter of a sphere having the volume of a grain calculated from the projected area and the grain thickness or the diameter of a sphere having the volume determined according to the Coulter counter method. The grain may be selected from the range of from an ultrafine grain having a sphere-corresponding diameter of 0.05 $\mu$m to a coarse grain having a sphere-corresponding diameter in excess of 10 $\mu$m. Grains having a sphere-corresponding diameter of from 0.1 to 3 $\mu$m are preferred.

The silver halide grains may have any grain size distribution, but a monodisperse distribution is preferred. The monodisperse distribution as used herein is defined as a dispersion system where 95% by weight or number of grains in all silver halide grains contained in the emulsion have a grain size falling within ±60%, preferably within 40%, of the number average grain size. The number average grain size as used herein means a number average diameter, in terms of the projected area diameter, of silver halide grains.

The structure and the production method of monodisperse tabular grains are described, for example, in JP-A-63-151618, and a mixture of those monodisperse emulsions may also be used.

With respect to the silver halide composition of the grain, any silver halide of silver iodobromide, silver iodochlorobromide or silver chloroiodide may be used but silver iodobromide is preferred.

The silver halide grain has different phases between the inside and the surface. The silver halide composition inside the grain may be homogeneous or may comprise a heterogeneous silver halide composition. The surface phase may be a discontinuous layer or may form a continuous layer structure. Also, the grain may have a dislocation line.

Controlling of the halogen composition in the vicinity of the surface of a grain is important. In the case of changing the halogen composition in the vicinity of the surface, either a structure of entirely embracing the grain or a structure of adhering only to a part of the grain may be selected. For example, only one part face of a tetradecahedral grain comprising a (100) face and a (111) face may be changed in the halogen composition or one of the main plane and the lateral plane may be changed in the halogen composition.

Two or more kinds of silver halides different in the crystal habit, halogen composition, grain size, grain size distribution or the like may be used in combination and these may be used in different emulsion layers and/or in the same emulsion layer.

After a shell is covered on a core grain subjected to chemical sensitization, the silver halide emulsion of the present invention is preferably further subjected to chemical sensitization of the grain surface but may not be subjected to chemical sensitization of the grain surface. In general, superior reversal performance with a high maximum density is attained when the grain surface is chemically sensitized. In the case of chemically sensitizing the grain surface, a polymer described in JP-A-57-13641 may be allowed to be present together.

The chemical sensitization may be performed using an active gelatin as described in T. H. James. *The Theory of the Photographic Process,* 4th ed., pp. 67–76, Macmillan (1977) or may be performed using sulfur, selenium, tellurium, gold, platinum palladium, iridium, rhodium, osmium, rhenium or a combination of two or more of these sensitizing agents at a pAg of from 5 to 10, a pH of from 4 to 8 and a temperature of from 30 to 80° C. as described in *Research Disclosure,*

Vol. 120, 12008 (April, 1974), *Research Disclosure,* Vol. 34, 13452 (June, 1975), U.S. Pat. Nos. 2,642,361, 3,297,446, 3,772,031, 3,857,711, 3,901,714, 4,266,018 and 3,904,415, and British Patent 1,315,755.

The chemical sensitization of the photographic emulsion of the present invention may be performed in a metal material such as Fe, Cr, Mn, Ni, Mo and Ti, but is preferably performed in a non-metallic material obtained by coating a fluororesin on the surface of a metal. Examples of the fluororesin material include Teflon-coated materials such as PFA, TFE and FEP produced by Du Pont.

The chemical sensitization may also be performed in the presence of a chemical sensitization aid. As the chemical sensitization aid, a compound known to control the fogging and increase the sensitivity during the process of chemical sensitization, such as azaindene, azapyridazine and azapyrimidine, is used. Examples of the chemical sensitization aid are described in U.S. Pat. Nos. 2,131,038, 3,411,914 and 3,554,757, JP-A-58-126536, JP-A-62-253159, and Duffin, *Photographic Emulsion Chemistry,* pp. 138–143, The Focal Press (1966).

In the process of forming by precipitation the silver halide emulsion, the inside of a grain may be reduction sensitized as described in JP-B-58-1410 and Moisar et al., *Journal of Photographic Science,* Vol. 25, pp. 19–27 (1977).

As the chemical sensitization, the reduction sensitization described below may also be used. Examples of the reduction sensitization which can be used include the reduction sensitization using hydrogen described in U.S. Pat. Nos. 3,891,446 and 3,984,249 and the reduction sensitization using a reducing agent by a low pH (for example, less than 5) or high pH (for example, in excess of 8) processing described in U.S. Pat. Nos. 2,518,698, 2,743,182 and 2,743,183. Representative known examples of the reducing sensitizer include stannous salts, ascorbic acids and derivatives thereof, amines and polyamines, hydrazine derivatives, formdiaminesulfinic acids, silane compounds, and borane compounds. In the reduction sensitization of the present invention, a compound selected from those known reduction sensitizers may be used and two or more compounds may be used in combination. Preferred compounds as the reduction sensitizer are stannous chloride, thiourea dioxide, dimethylamineborane, and an ascorbic acid or a derivative thereof.

Furthermore, chemical sensitization methods described in U.S. Pat. Nos. 3,917,485 and 3,966,476 may also be used.

The sensitization method using an oxidizing agent described in JP-A-61-3134 and JP-A-61-3136 may also be used.

The oxidizing agent for silver means a compound having an activity of acting on a silver metal to convert it into silver ion. In particular, a compound capable of converting very fine silver grains by-produced during the formation or chemical sensitization of silver halide grains into silver ion is effective. The silver ion produced may form a sparingly water-soluble silver salt such as silver halide, silver sulfide and silver selenide, or may form an easily water-soluble silver salt such as silver nitrate. The oxidizing agent for silver may be either an inorganic material or an organic material. Examples of the inorganic oxidizing agent include oxyacid salts such as ozone, hydrogen peroxide and an adduct thereof (e.g., $NaBO_2.H_2O_2.3H_2O.2NaCO_3.3H_2O_2$, $Na_4P_2O_7.2H_2O_2$, $2Na_2SO_4.H_2O_2.2H_2O$), peroxy acid salt (e.g., $K_2S_2O_8$, $K_2C_2O_6$, $K_2P_2O_8$), a peroxy complex compound (e.g., $K_2[Ti(O_2)C_2O_4].3H_2O$, $4K_2SO_4.Ti(O_2)OH.SO_4.2H_2O$), a permanganate (e.g., $KMnO_4$) and a chromate (e.g., $K_2Cr_2O_7$), halogen elements such as iodine and bromine, perhalogen acid salts (e.g., potassium periodate), and salts of a high valence metal (e.g., potassium hexacyanoferrate).

Examples of the organic oxidizing agent include quinones such as p-quinone, organic peroxides such as peracetic acid and perbenzoic acid, and active halogen-releasing compounds (e.g., N-bromosuccinimide, chloramine T, chloramine B).

The oxidizing agent preferably used in the present invention is ozone, hydrogen peroxide or an adduct thereof, a halogen element or an organic oxidizing agent such as quinones. In a preferred embodiment, the above-described reduction sensitization and the oxidizing agent for silver are used in combination. A method of using an oxidizing agent and then performing reduction sensitization, a method reversed thereto, or a method of allowing both to be present together may be selected and used. These methods may be used during the grain formation or in the chemical sensitization.

Gelatin is advantageous as a protective colloid for use in the preparation of the emulsion of the present invention, however, other hydrophilic colloids may also be used.

Examples thereof include proteins such as gelatin derivatives, graft polymers of gelatin to other polymer, albumin and casein; saccharide derivatives such as cellulose derivatives, e.g., hydroxyethyl cellulose, carboxymethyl cellulose and cellulose sulfate, sodium arginates and starch derivatives; and various synthetic hydrophilic polymer materials such as homopolymers and copolymers of polyvinyl alcohol, polyvinyl alcohol partial acetal, poly-N-vinylpyrrolidone, polyacrylic acid, polymethacrylic acid, polyacrylamide, polyvinyl imidazole or polyvinyl pyrazole.

The gelatin may be a lime-processed gelatin, an acid-processed gelatin or an enzyme-processed gelatin described in *Bull. Soc. Photo. Japan,* No. 16, p. 30 (1966). Furthermore, a hydrolysate or enzymolysate of gelatin may also be used.

Gelatin contains may impurity ions and use of a gelatin subjected to an ion exchange treatment and thereby reduced in the impurity ion amount is also preferred.

The emulsion of the present invention is preferably washed with water and dispersed in a newly prepared protective colloid for the purpose of desalting. The temperature at the water washing may be selected according to the purpose but it is preferably from 5 to 50° C. The pH at the water washing may also be selected according to the purpose but it is preferably from 2 to 10, more preferably from 3 to 8. Furthermore, the pAg at the water washing may be selected according to the purpose but it is preferably from 5 to 10. The water washing may be performed by a method selected from a noodle washing method, a dialysis method using a semipermeable membrane, a centrifugal separation method, a coagulating precipitation method and an ion exchange method. In the case of the coagulating precipitation method, a method of using a sulfate, a method of using an organic solvent, a method of using a water-soluble polymer or a method of using a gelatin derivative may be selected.

In the present invention, spectral sensitization may be performed using a sensitizing dye. The sensitizing dye used to this purpose is a cyanine dye, a merocyanine dye, a complex cyanine dye, a complex merocyanine dye, a holopolar cyanine dye, a hemicyanine dye, a styryl dye or a hemioxonol dye. Specific examples thereof include the sensitizing dyes described in U.S. Pat. No. 4,617,257, JP-A-59-180550, JP-A-60-140335, JP-A-61-160739, RD17029, pp. 12–13 (1978), and RD17643, page 23 (1978).

These sensitizing dyes may be used either individually or in combination and the combination of sensitizing dyes is often used for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, JP-B-43-4936, JP-B-53-12375, JP-A-52-110618 and JP-A-52-109925.

In combination with the sensitizing dye, a dye which does not have a spectral sensitization activity by itself or a material which does not substantially absorb a visible light, but which exhibits supersensitization may be contained in the emulsion (for example, those described in U.S. Pat. Nos. 3,615,613, 3,615,641, 3,617,295, 3,635,721, 2,933,390 and 3,743,510, and JP-A-63-23145).

The time when the sensitizing dye for spectral sensitization is added to the emulsion may be any stage known to be useful in the process of preparing the emulsion. Most commonly, the sensitizing dye is added after the completion of chemical sensitization and prior to the coating, but the sensitizing dye may be added at the same time with the chemical sensitizing dye to effect spectral sensitization and chemical sensitization simultaneously as described in U.S. Pat. Nos. 3,628,969 and 4,225,666, the sensitizing dye may be added in advance of the chemical sensitization as described in JP-A-58-113928, or the sensitizing dye may be added before the completion of formation by precipitation of the silver halide grains to initiate the spectral sensitization. Furthermore, the above-described compound may be added in parts, more specifically, a part of the compound may be added in advance of the chemical sensitization and the remaining may be added after the chemical sensitization as described in U.S. Pat. No. 4,225,666. Thus, the sensitizing dye may be added at any stage during the formation of silver halide grains as in the method described in U.S. Pat. No. 4,183,756.

The amount of the sensitizing dye added may be from $10^{-8}$ to $10^{-3}$ mol per mol of silver halide but in the case of a silver halide grain having a grain size of from 0.2 to 1.2 $\mu$m, which is more preferred in the present invention, it is more effective to add the sensitizing dye in an amount of from about $5\times10^{-5}$ to $2\times10^{-3}$ mol per mol of silver halide.

The coated amount of the light-sensitive silver halide for use in the present invention is from 1 mg to 10 g/m$^2$ in terms of silver.

In the present invention, various kinds of antifoggants and photographic stabilizers may be used for the purpose of preventing reduction in the sensitivity or generation of fogging. Examples thereof include azoles and azaindenes described in RD17643, pp. 24–25 (1978) and U.S. Pat. No. 4,629,678, nitrogen-containing carboxylic acids and phosphoric acids described in JP-A-59-168442, mercapto compounds and metal salts thereof described in JP-A-59-111636 and acetylene compounds described in JP-A-62-87957.

Furthermore, an antiseptic or antifungal of various types is preferably added, such as phenethyl alcohol and additionally, 1,2-benzisothiazolin-3-one, n-butyl, p-hydroxybenzoate, phenol, 4-chloro-3,5-dimethyl phenol, 2-phenoxyethanol and 2-(4-thiazolyl)benzimidazole described in JP-A-63-257747, JP-A-62-272248 and JP-A-1-80941. These are described in detail in EP-A-436938, page 150, lines 25 to 28.

These additives are described in more detail in *Research Disclosure,* Item 17643 (1978), ibid., Item 18716 (November, 1979) and ibid., Item 307105 (November, 1989) and the pertinent portions thereof are summarized in the table below.

| | Kind of Additives | RD17643 (Dec., 1978) | RD18716 (Nov., 1979) | RD307105 (Nov., 1989) |
|---|---|---|---|---|
| 1 | Chemical sensitizer | p. 23 | p. 646, right column | p. 666 |
| 2 | Sensitivity increasing agent | | p 648, right column | |
| 3 | Spectral sensitizer, supersensitizer | pp. 23–24 | p. 648, right column to p. 649, right column | pp. 866–868 |
| 4 | Brightening agent | p. 24 | p. 647, right column | p. 868 |
| 5 | Antifoggant, stabilizer | pp. 24–25 | p. 649, right column | pp. 868–870 |
| 6 | Light absorber, filter dye, UV absorbent | pp. 25–26 | p. 649, right column to p. 650, left column | p. 873 |
| 7 | Stain inhibitor | p. 25, right column | p. 650, left to light columns | p. 872 |
| 8 | Dye image stabilizer | p. 25 | p. 650, left column | p. 872 |
| 9 | Hardener | p. 26 | p. 651, left column | pp. 874–875 |
| 10 | Binder | p. 26 | p. 651, left column | pp. 873–874 |
| 11 | Plasticizer, lubricant | p. 27 | p. 650, right column | p. 876 |
| 12 | Coating aid, surfactant | pp. 26–27 | p. 650 right column | pp. 875–876 |
| 13 | Antistatic agent | p. 27 | p. 650 right column | pp. 676–877 |
| 14 | Matting agent | | | pp. 878–879 |

The color diffusion transfer light-sensitive material of the present invention is described below.

A most representative example of the color diffusion transfer material is a color diffusion transfer film unit. One representative embodiment thereof is a film unit of such a type that an image-receiving element and a light-sensitive element are stacked on one transparent support, where after the completion of a transfer image, the light-sensitive element is not necessary to be stripped off from the image-receiving element. To speak more specifically, the image-receiving element comprises at least one mordanting layer. The light-sensitive element preferably comprises a combination of a blue-sensitive emulsion layer, a green-sensitive emulsion layer and a red-sensitive emulsion layer, a combination of a green-sensitive emulsion layer, a red-sensitive emulsion layer and an infrared-sensitive emulsion layer, or a combination of a blue-sensitive emulsion layer, a red-sensitive emulsion layer and an infrared-sensitive emulsion layer (the term "infrared-sensitive emulsion layer" as used herein means an emulsion layer having a spectral sensitivity maximum to the light at 700 nm or more, particularly 740 nm or more), each emulsion layer being combined with a yellow dye image-forming compound, a magenta dye image-forming compound or a cyan dye image-forming compound. Between the mordanting layer and the light-sensitive layer or the dye image-forming compound-containing layer, a white reflective layer containing a solid pigment such as titanium oxide is provided so as to enable viewing the transferred image through the transparent support.

Between the white reflective layer and the light-sensitive layer, a light-shielding layer may further be provided so that the development can be accomplished in a bright place. Furthermore, if desired, a release layer may be provided at an appropriate site so that the light-sensitive layer can be wholly or partly stripped off from the image-receiving element. Such an embodiment is described, for example, JP-A-56-67840 and Canadian Patent 674,082.

As the stacked layer type film unit where the elements are stripped off, JP-A-63-226649 describes a color diffusion transfer photographic film unit comprising a white support having thereon a light-sensitive element consisting of at least (a) a layer having a neutralizing function, (b) a dye image-receiving layer, (c) a release layer and (d) at least one silver halide emulsion layer combined with a dye image-forming compound in this order, an alkali processing composition containing a light-shielding agent and a transparent cover sheet, where a layer having a light-shielding function is provided on the side of the emulsion layer opposite to the side having spread thereon the processing composition.

In another non-stripping type film unit, the above-described light-sensitive element is provided on one transparent support, a white reflective layer is provided on the light-sensitive element, and an image layer is further stacked on the white reflective layer. Also, a film unit of such a type that an image-receiving element, a white reflective layer, a release layer and a light-sensitive element are stacked on the same support and the light-sensitive element is intentionally stripped off from the image-receiving element is described in U.S. Pat. No. 3,730,718.

Another representative embodiment is a film unit where the light-sensitive element and the image-receiving element are separately provided on respective two supports, and this embodiment is roughly classified into two groups. One is a stripping type film unit and another is a non-stripping type film unit. These types of film units are described in detail below. In a preferred embodiment of the stripping type film unit, at least one image-receiving layer is provided on one support and the light-sensitive element is provided on a support having thereon a light-shielding layer, where the light-sensitive layer coated surface and the mordanting layer coated surface do not face each other before the completion of exposure, however, it is designed so that after the completion of exposure (for example, during the development), the light-sensitive layer coated surface can be reversed within an image forming apparatus and contact the image-receiving layer coated surface. After a transfer image is completed on the mordanting layer, the light-sensitive element is swiftly stripped off from the image-receiving element.

In a preferred embodiment of the non-stripping type film unit, at least one mordanting layer is provided on a transparent support, the light-sensitive element is provided on a transparent support or a support having thereon a light-shielding layer, and these supports are superposed one on another so that the light-sensitive layer coated surface and the mordanting layer coated surface can face each other.

These film units each may be combined with a container containing an alkaline processing solution and capable of rupturing under a pressure (processing element). In the case of a non-stripping type film unit where the image-receiving element and the light-sensitive element are stacked on one support, the processing element is preferably disposed between the light-sensitive element and the cover sheet superposed thereon. In the case of a film unit where the light-sensitive element and the image-receiving element are separately provided on two supports, the processing element is preferably disposed between the light-sensitive element and the image-receiving element at the latest during the development processing. Depending on the film unit, the processing element preferably contains one or both of a light-shielding agent (e.g., carbon black or a dye of which color is variable by the pH) and a white pigment (e.g., titanium oxide). Furthermore, in the film unit using the color diffusion transfer system, a neutralization timing mechanism comprising a combination of a neutralizing layer and a neutralization timing layer is preferably integrated into the cover sheet, the image-receiving element or the light-sensitive element.

The dye image-forming substance for use in the present invention is a non-diffusive compound which releases a diffusive dye (or a dye precursor) in connection with the silver development, or a compound of which diffusibility itself changes, and this is described in *The Theory of the Photographic Process,* 4th ed. These compounds both may be represented by the following formula (I):

$$(DYE-Y)_n-Z \qquad (I)$$

wherein DYE represents a dye group, a dye group temporarily shifted to the short wave or a dye precursor group, Y represents a mere bond or a linking group, Z represents a group having capability of releasing a diffusive dye or a precursor thereof in connection with the silver development or differentiating the diffusibility of the compound represented by $(DYE-Y)_n-Z$, n represents 1 or 2, and when n is 2, two DYE–Y moieties may be the same or different.

The dye image-forming substance is roughly classified by the function of Z into a negative compound which becomes diffusive in the silver developed area, and a positive compound which becomes diffusive in the undeveloped area.

Z in the negative type compound is oxidized as a result of development and cleaved to release a diffusive dye.

Specific examples of Z include those described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322 and 4,139,389, JP-A-53-50736, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342, and JP-A-57-119345.

Among the groups for Z in the negative dye releasing redox compound, particularly preferred is an N-substituted sulfamoyl group (the N-substituent is a group derived from an aromatic hydrocarbon ring or a heterocyclic ring). Representative examples of this group for Z are set forth below, however, the present invention is by no means limited thereto.

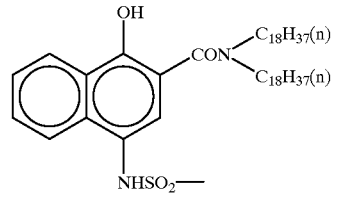

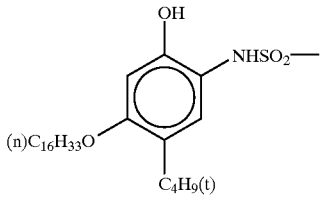

-continued

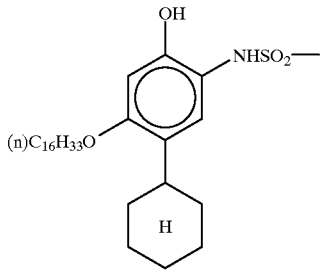

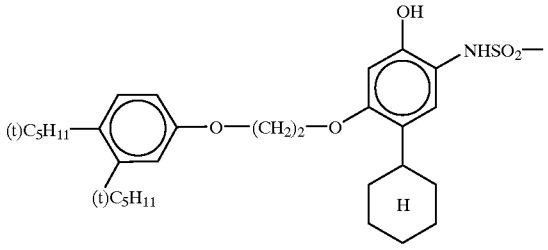

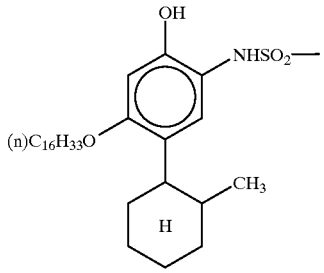

With respect to the positive compound, *Angev. Chem. Int. Ed. Ingl.,* 22, 191 (1982) describes the compound.

More specifically, the positive compound includes a compound which is initially diffusive under alkali conditions but is oxidized by the development and becomes non-diffusive (dye developer). Representative examples of Z effective for the compound of this type include those described in U.S. Pat. No. 2,983,606.

The positive compound also includes a compound where self ring closing or the like takes place under alkaline conditions and the diffusive dye is released but when the compound is oxidized, the dye is not substantially released. Specific examples of Z having such a function include those described in U.S. Pat. No. 3,980,479, JP-A-53-69033, JP-A-54-130927, and U.S. Pat. Nos. 3,421,964 and 4,199,355.

Furthermore, the positive compound includes a compound which does not release the dye by itself but when the compound is reduced, releases the dye. When a compound of this type is used in combination with an electron donor, the compound reacts with the electron donor which is imagewise oxidized by the silver development, and thereby the diffusive dye can be imagewise released. The atomic group having such a function is described, for example, in U.S. Pat. Nos. 4,183,753, 4,142,891, 4,278,750, 4,139,379 and 4,218,368, JP-A-53-110827, U.S. Pat. Nos. 4,278,750, 4,356,249 and 4,358,535, JP-A-53-110827, JP-A-54-130927, JP-A-56-164342, JIII Journal of Technical Disclosure No. 87-6199, and JP-A-220746.

Specific examples of Z for the compound of this type are set forth below, however, the present invention is by no means limited thereto.

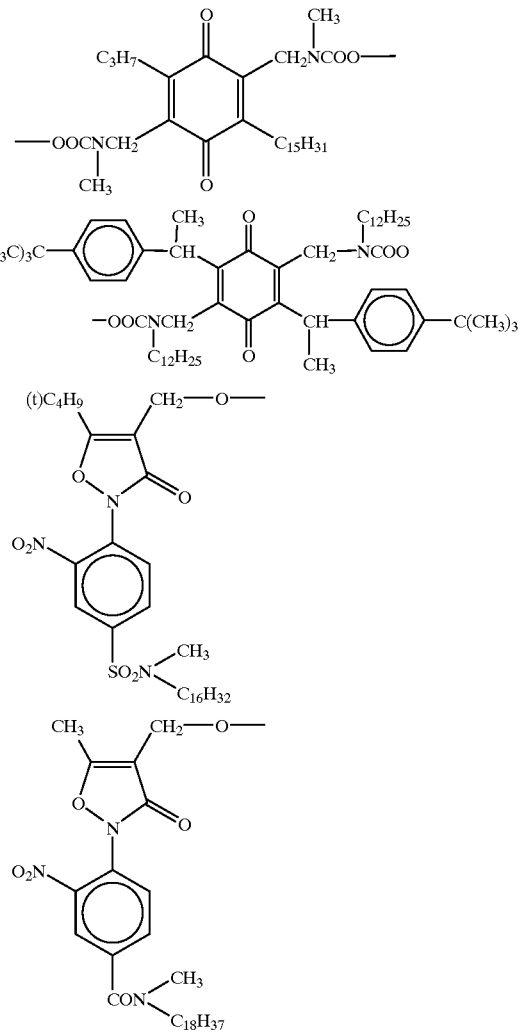

The compound of this type is preferably used in combination with a non-diffusive electron donating compound (well known as ED compound) or a precursor thereof. Examples of the ED compound include those described, for example, in U.S. Pat. Nos. 4,263,393 an 4,278,750 and JP-A-56-138736.

Another type of the dye image-forming substance may be used and specific examples thereof are set forth below.

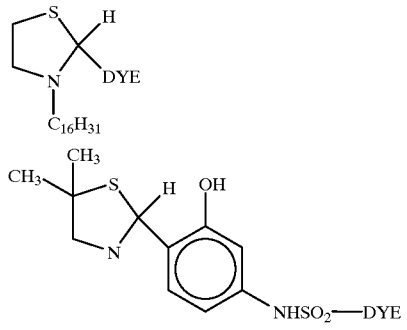

These compounds are described in detail in U.S. Pat. Nos. 3,719,489 and 4,098,783.

On the other hand, specific examples of the dye represented by DYE of formula (I) are described in the following publications.

Examples of Yellow Dye

U.S. Pat. Nos. 3,597,200, 3,309,199, 4,013,633, 4,245,028, 4,156,609, 4,139,383, 4,195,992, 4,148,641, 4,148,643 and 4,336,322, JP-A-51-114930, JP-A-56-71072, *Research Disclosure,* No. 17630 (1978), and ibid., No. 16475 (1977).

Examples of Magenta Dye

U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, JP-A-52-106727, JP-A-53-23628, JP-A-55-36804, JP-A-56-73057, JP-A-56-71060 and JP-A-55-134.

Examples of Cyan Dye

U.S. Pat. Nos. 3,482,972, 3,929,760, 4,013,635, 4,268,625, 4,171,220, 4,242,435, 4,142,891, 4,195,994, 4,147,544 and 4,148,642, British Patent 1,551,138, JP-A-54-99431, JP-A-52-8827, JP-A-53-47823, JP-A-53-143323, JP-A-54-99431, JP-A-56-71061, European Patents (EP) 53,037 and 53,040, *Research Disclosure,* No. 17630 (1978), and ibid., No. 16475 (1977).

These compounds each may be dispersed by the method described in JP-A-62-215272, pp. 144–146. Furthermore, the dispersion may contain the compounds described in JP-A-62-215272, pp. 137–144.

The present invention is described in greater detail below by referring to the Examples, however, the present invention should not be construed as being limited thereto.

EXAMPLE 1

The preparation method of the silver halide emulsion is described below.

Ten kinds of silver halide emulsion grains (Emulsion A to Emulsion G and Emulsions T, U and X) were prepared according to the methods described below.

Preparation of Emulsion A (Octahedral Internal Latent Image-type Direct Positive Emulsion)

To 1,000 ml of an aqueous gelatin solution containing 0.05 M potassium bromide, 1 g of 3,6-dithia-1,8-octanediol, 0.034 mg of lead acetate and 60 g of deionized gelatin having a Ca content of 100 ppm or less, 0.4 M aqueous silver nitrate solution and 0.4 M aqueous potassium bromide solution were added while keeping the temperature at 75° C. by a controlled double jet method such that 300 ml of the aqueous silver nitrate solution was added over 40 minutes while controlling the addition rate of the aqueous potassium bromide solution so as to have a pBr of 1.60.

After the completion of addition, octahedral silver bromide crystals (hereinafter called a core grain) having a uniform grain size of about 0.7 μm in terms of the average grain size (sphere-corresponding diameter) were produced.

Thereafter, chemical sensitization of the core was performed in a vessel described below according to the following formulation.

1. Tank

A tank having a hemispherical bottom obtained by teflon-coating the surface of a metal with a fluororesin material FEP produced by Du Pont to have a thickness of 120 μm.

2. Stirring Blade

A seamless and integrated propeller type blade made of a metal of which surface was teflon-coated.

3. Formulation

To a solution of the octahedral direct positive emulsion prepared above, 3 ml of an aqueous solution obtained by dissolving 1 mg of sodium thiosulfate, 90 mg of potassium aurate tetrachloride and 1.2 g of potassium bromide in 1,000 ml of water was added. The mixed solution was heated at 75° C. for 80 minutes to perform chemical sensitization. To the resulting emulsion solution subjected to chemical sensitization, 0.15 M potassium bromide was added. Thereafter, in the same manner as in the preparation of the core grain, 0.9 M aqueous silver nitrate solution and 0.9 M aqueous silver potassium bromide solution were added while keeping the temperature at 75° C. by a controlled double jet method such that 670 ml of the aqueous silver nitrate solution was added over 70 minutes while controlling the addition rate of the aqueous potassium nitrate solution so as to have a pBr of 1.30.

The emulsion obtained was washed with water by an ordinary flocculation method and thereto, the gelatin described above, 2-phenoxyethanol and methyl p-hydroxybenzoate were added. As a result, octahedral silver bromide crystals (hereinafter called an "internal latent image-type core/shell grain") having a uniform crystal size of about 1.4 μm in terms of the average grain size (sphere-corresponding diameter) were obtained.

To the thus-obtained internal latent image-type core/shell emulsion, 3 ml of an aqueous solution obtained by dissolving 100 mg of sodium thiosulfate and 40 mg of sodium tetraborate in 1,000 ml of water was added and furthermore, 14 mg of poly(N-vinylpyrrolidone) was added. The resulting emulsion solution was ripened under heating at 60° C. and thereto 0.005 M potassium bromide was added, thereby preparing an octahedral internal latent image-type direct positive emulsion.

Preparation of Emulsions B to G (Octahedral Internal Latent Image-type Direct Positive Emulsion)

Octahedral internal latent image-type direct positive silver halide emulsions each having a uniform grain size shown in Table 1 below in terms of the average grain size (sphere-corresponding diameter) were prepared by changing the addition time of the aqueous silver nitrate solution or the aqueous potassium bromide solution and also changing the amount of chemicals added, in the preparation of Emulsion A.

TABLE 1

| Emulsion Name | Average Grain Size, μm |
|---|---|
| B | 1.20 |
| C | 0.93 |
| D | 1.20 |
| E | 0.94 |
| F | 0.74 |
| G | 0.66 |

Preparation of Emulsion T (Hexagonal Tabular Internal Latent Image-type Direct Positive Emulsion)

Into 1.2 l of an aqueous gelatin solution containing 0.05 M potassium bromide and 0.7 wt % of gelatin having an average molecular weight of 100,000 or less, 1.4 M aqueous silver nitrate solution containing the same gelatin used above and 2 M potassium bromide were simultaneously mixed each in an amount of 33 ml over 1 minute under vigorous stirring by a double jet method. During the mixing, the aqueous gelatin solution was kept at 30° C. Furthermore, 300 ml of an aqueous gelatin solution containing 10 wt % of deionized gelatin having a Ca content of 100 ppm or less was added. Then, the temperature of the mixed solution was elevated to 75° C.

Subsequently, 40 ml of 0.9 M aqueous silver nitrate solution was added over 3 minutes and also a 25 wt % aqueous ammonia solution was added. The resulting solution was ripened at 75° C. After the completion of ripening, the ammonia was neutralized, 5 mg of lead acetate was added (added in the form of an aqueous solution), and then 1 M aqueous silver nitrate solution and 1 M aqueous potassium bromide solution were added at an accelerated flow rate (the flow rate at the end was 6 times the flow rate at the initiation) by a double jet method while keeping the pBr at 2.5 (the amount of aqueous silver nitrate solution used was 500 ml).

The thus-formed grains (hereinafter called a core grain) were washed with water by an ordinary flocculation method and thereto gelatin, 2-phenoxyethanol and methyl p-hydroxybenozate were added to obtain 750 g of a hexagonal tabular core grain.

The thus-obtained hexagonal tabular core grain had an average diameter of 0.9 μm in terms of the diameter of a circle having the same projected area and an average thickness of 0.20 μm, and 95% of the entire projected area of all grains was occupied by hexagonal tabular grains.

Thereafter, chemical sensitization of the core was performed using a vessel described below according to the following formulation.

1. Tank

A tank having a hemispherical bottom obtained by teflon-coating the surface of a metal with a fluororesin material FEP produced by Du Pont to have a thickness of 120 μm.

2. Stirring Blade

A seamless and integrated propeller type blade made of a metal of which surface was teflon-coated.

3. Formulation

To 200 g of the hexagonal tabular core emulsion, 1,300 ml of water, 0.11 M potassium bromide and 40 g of deionized gelatin were added. After elevating the temperature to 75° C., 2.4 ml of an aqueous solution obtained by dissolving 0.3 g of 3,6-dithia-1,8-octanediol, 10 mg of sodium benzenethiosulfate, 90 mg of potassium aurate tetrachloride and 1.2 g of potassium bromide in 1,000 ml of water and 15 mg of lead acetate (in the form of an aqueous solution) were added. The solution obtained was heated at 75° C. for 180 minutes to perform chemical sensitization. To the resulting core grain subjected to chemical sensitization, in the same manner as in the preparation of the core grain, 2 M aqueous silver nitrate solution and 2.5 M aqueous potassium bromide solution were added at an accelerated flow rate (the flow rate at the end was 3 times the flow rate at the initiation) by a double jet method while controlling the addition rate of the aqueous potassium bromide solution so as to have pBr of 2.2 (the amount of the aqueous silver nitrate solution used was 810 ml).

After adding thereto 0.3 M potassium bromide, the emulsion obtained was washed with water by an ordinary flocculation method and thereto gelatin was added to obtain a hexagonal tabular internal latent image-type core/shell emulsion. The thus-obtained hexagonal tabular grain had an average diameter of 2.0 μm in terms of the diameter of a circle having the same projected area, an average thickness of 0.38 μm and an average volume size of 1.3 $(\mu m)^3$, and 88% of the entire projected area of all grains was occupied by hexagonal tabular grains.

Thereafter, to this hexagonal tabular internal latent image-type core/shell emulsion, 15 ml of an aqueous solution obtained by dissolving 100 mg of sodium thiosulfate and 40 mg of sodium tetraborate in 1,000 ml of water was added and furthermore, 20 mg of poly(N-vinyl-pyrrolidone) was added. The resulting solution was heated at 70° C. for 100 minutes to perform chemical sensitization of the grain surface, thereby preparing a hexagonal tabular internal latent image-type direct positive emulsion.

Preparation of Emulsion X (Fine Grain AgT Emulsion)

To a solution obtained by adding 0.5 g of potassium iodide and 26 g of gelatin to water and kept at 35° C., 80 ml of an aqueous silver nitrate solution containing 40 g of silver nitrate and 80 ml of an aqueous solution containing 39 g of potassium iodide were added over 5 minutes. At this time, the aqueous silver nitrate solution and the aqueous potassium iodide solution each was added at a flow rate of 8 ml/min at the initiation of addition, and the flow rate was linearly accelerated so that the addition of 80 ml of each solution could be completed within 5 minutes.

After the completion of grain formation, soluble salts were removed at 35° C. by precipitation and then, the temperature was elevated to 40° C. Thereafter, 10.5 g of gelatin and 2.56 g of phenoxyethanol were added and the pH of the resulting solution was adjusted to 6.8 by sodium hydroxide. As a result, an emulsion was obtained in a finished amount of 730 g and the emulsion was a monodisperse fine grain AgI having an average diameter of 0.015 μm.

Preparation of Emulsion U (Hexagonal Tabular Internal Latent Image-type Direct Positive Emulsion)

At the formation of outer shell in the preparation of Emulsion T, 0.15 mol % of iodide was uniformly incorporated into the outer sell and furthermore, the amount of the outer shell formed was increased. The thus-obtained emulsion grain had an average diameter of 2.5 μm in terms of the diameter of a circle having the same projected area, an average grain thickness of 0.45 μm and an average volume size of 1.7 $(\mu m)^3$, and 88% of the entire projected area of all grains was occupied by hexagonal tabular grains.

Thereafter, the shell was subjected to chemical sensitization in the same manner as in Emulsion T to prepare a hexagonal tabular internal latent image-type direct positive emulsion.

Before the initiation of chemical sensitization of the shell (before the addition of sodium thiosulfate), iodide was supplied as follows to prepare Emulsions A-1, A-2, A-5, T-1, T-2, T-5, U-1, U-2 and U-5 for comparison, and Emulsions A-3, A-4, A-6 to A-8, T-3, T-4, T-6 to T-8, U-3, U-4, U-6 to U-8 of the present invention.

Octahedral Emulsion A-1 for Comparison

In Emulsion A, pure silver bromide was used as it is without depositing iodide on the surface thereof at all.

Octahedral Emulsion A-2 for Comparison

In Emulsion A, 1% aqueous KI solution was added over 5 minutes in an amount of 0.4 mol % based on the entire silver amount.

Octahedral Emulsion A-3 of the Invention

In Emulsion A, 1% aqueous KI solution was added over 5 minutes in an amount of 0.25 mol % based on the entire silver amount.

Octahedral Emulsion A-4 of the Invention

In Emulsion A, 1% aqueous KI solution was added over 5 minutes in an amount of 0.1 mol % based on the entire silver amount.

Octahedral Emulsion A-5 for Comparison

In Emulsion A, 0.4 mol % of fine grain AgI Emulsion X was added and then physical ripening was performed for 5 minutes.

Octahedral Emulsion A-6 of the Invention

In Emulsion A, 0.25 mol % of fine grain AgI Emulsion X was added and then physical ripening was performed for 5 minutes.

Octahedral Emulsion A-7 of the Invention

In Emulsion A, 0.1 mol % of fine grain AgI Emulsion X was added and then physical ripening was performed for 5 minutes.

Octahedral Emulsion A-8 of the Invention

In Emulsion A, a 1% aqueous silver nitrate solution and a 1% aqueous KI solution were added each in an amount of 0.25 mol % over 5 minutes by a double jet method.

Tabular Grain T-1 for Comparison

In Emulsion T, pure silver bromide was used as it is without depositing iodide on the surface thereof at all.

Tabular Grain T-2 for Comparison

In Emulsion T, a 1% aqueous KI solution was added over 5 minutes in an amount of 0.4 mol % based on the total silver amount.

Tabular Grain T-3 of the Invention

In Emulsion T, a 1% aqueous KI solution was added over 5 minutes in an amount of 0.12 mol % based on the total silver amount.

Tabular Grain T-4 of the Invention

In Emulsion T, a 1% aqueous KI solution was added over 5 minutes in an amount of 0.05 mol % based on the total silver amount.

Tabular Grain T-5 for Comparison

In Emulsion T, 0.4 mol % of fine grain AgI Emulsion X was added and then physical ripening was performed for 5 minutes.

Tabular Grain T-6 of the Invention

In Emulsion T, 0.12 mol % of fine grain AgI Emulsion X was added and then physical ripening was performed for 5 minutes.

Tabular Grain T-7 of the Invention

In Emulsion T, 0.05 mol % of fine grain AgI Emulsion X was added and then physical ripening was performed for 5 minutes.

Tabular Grain T-8 of the Invention

In Emulsion T, a 1% aqueous silver nitrate solution and a 1% aqueous KI solution were added each in an amount of 0.12 mol % over 5 minutes by a double jet method.

Tabular Grain U-1 for Comparison

In Emulsion U, pure silver bromide was used as it is without depositing iodide on the surface thereof at all.

Tabular Grain U-2 for Comparison

In Emulsion U, a 1% aqueous KI solution was added over 5 minutes in an amount of 0.4 mol % based on the total silver amount.

Tabular Grain U-3 of the Invention

In Emulsion U, a 1% aqueous KI solution was added over 5 minutes in an amount of 0.12 mol % based on the total silver amount.

Tabular Grain U-4 of the Invention

In Emulsion U, a 1% aqueous KI solution was added over 5 minutes in an amount of 0.05 mol % based on the total silver amount.

Tabular Grain U-5 for Comparison

In Emulsion U, 0.4 mol % of fine grain AgI Emulsion X was added and then physical ripening was performed for 5 minutes.

Tabular Grain U-6 of the Invention

In Emulsion U, 0.12 mol % of fine grain AgI Emulsion X was added and then physical ripening was performed for 5 minutes.

Tabular Grain U-7 of the Invention

In Emulsion U, 0.05 mol % of fine grain AgI Emulsion X was added and then physical ripening was performed for 5 minutes.

Tabular Grain U-8 of the Invention

In Emulsion U, a 1% aqueous silver nitrate solution and a 1% aqueous KI solution were added each in an amount of 0.12 mol % over 5 minutes by a double jet method.

Using Emulsions A to G, light sensitive elements (Sample 101) having a structure shown below were prepared. The kind, the dispersion form, the addition temperature and the amount of the sensitizing dyes added at the completion of chemical sensitization of the shell are shown in Table 1 below.

Structure of Light-Sensitive Element 101 for Comparison

| Layer No. | Layer Name | Additive | Amount Coated ($g/m^2$) |
|---|---|---|---|
| 22nd Layer | Protective Layer | Matting Agent (1) | 0.15 |
| | | Gelatin | 0.25 |
| | | Surface Active Agent (1) | $5.3 \times 10^{-3}$ |
| | | Surface Active Agent (2) | $4.1 \times 10^{-3}$ |
| | | Surface Active Agent (3) | $3.9 \times 10^{-3}$ |
| | | Additive (1) | $8.0 \times 10^{-3}$ |
| | | Additive (5) | 0.009 |
| 21st Layer | Ultraviolet Absorbing | Ultraviolet Absorbent (1) | 0.09 |
| | | Ultraviolet Absorbent (2) | 0.05 |
| | | Ultraviolet Absorbent (3) | 0.01 |
| | | Additive (2) | 0.17 |
| | | Surface Active Agent (3) | 0.013 |
| | | Surface Active Agent (4) | 0.019 |
| | | Additive (1) | $8.0 \times 10^{-3}$ |
| | | Additive (5) | 0.023 |
| | | Hardening Agent (1) | 0.050 |
| | | Hardening Agent (2) | 0.017 |
| | | Gelatin | 0.52 |
| 20th Layer | Blue-Sensitive Layer (high sensitivity) | Internal Latent Image-Type Direct Positive Emulsion: A-1 | 0.38 as silver |
| | | Nucleating Agent (1) | $2.9 \times 10^{-6}$ |
| | | Additive (3) | $4.0 \times 10^{-3}$ |
| | | Additive (4) | 0.013 |
| | | Additive (5) | $3.8 \times 10^{-3}$ |
| | | Additive (1) | $9.0 \times 10^{-3}$ |
| | | Surface Active Agent (5) | $9.0 \times 10^{-3}$ |
| | | Gelatin | 0.42 |
| 19th Layer | Blue-Sensitive Layer (low sensitivity) | Internal Latent Image-Type Direct Positive Emulsion: D | 0.07 as silver |
| | | Internal Latent Image-Type Direct Positive Emulsion: C | 0.10 as silver |
| | | Nucleating Agent (1) | $2.5 \times 10^{-6}$ |
| | | Additive (3) | 0.022 |
| | | Additive (5) | $9.0 \times 10^{-3}$ |
| | | Additive (1) | 0.013 |
| | | Surface Active Agent (5) | $9.0 \times 10^{-3}$ |
| | | Gelatin | 0.35 |
| 18th Layer | White Reflective Layer | Titanium dioxide | 0.30 |
| | | Additive (1) | $9.0 \times 10^{-3}$ |
| | | Surface Active Agent (1) | $7.2 \times 10^{-5}$ |
| | | Additive (5) | 0.011 |
| | | Additive (8) | $2.8 \times 10^{-3}$ |
| | | Gelatin | 0.37 |
| 17th Layer | | Yellow dye releasing compound (1) | 0.62 |
| | | High Boiling Point Organic Solvent (1) | 0.27 |
| | | Additive (6) | 0.18 |
| | | Additive (7) | 0.09 |
| | | Surface Active Agent (4) | 0.062 |
| | | Surface Active Agent (5) | 0.030 |
| | | Additive (9) | 0.031 |
| | | Additive (1) | $6.0 \times 10^{-3}$ |
| | | Gelatin | 0.87 |

-continued

| Layer No. | Layer Name | Additive | Amount Coated ($g/m^2$) |
|---|---|---|---|
| 16th Layer | Interlayer | Additive (10) | 0.013 |
| | | Surface Active Agent (1) | $4.0 \times 10^{-4}$ |
| | | Additive (1) | $7.0 \times 10^{-3}$ |
| | | Gelatin | 0.42 |
| 15th Layer | Color Stain Inhibiting Layer | Additive (11) | 0.47 |
| | | High Boiling Point Organic Solvent (2) | 0.23 |
| | | Polymethyl methacrylate | 0.81 |
| | | Surface Active Agent (5) | 0.019 |
| | | Additive (1) | $2.0 \times 10^{-3}$ |
| | | Additive (12) | 0.61 |
| | | Gelatin | 0.81 |
| 14th Layer | Green-Sensitive Layer sensitivity) | Internal Latent Image-Type Direct Positive (high Emulsion: A-1 | 0.69 as silver |
| | | Nucleating agent (1) | $2.2 \times 10^{-6}$ |
| | | Additive (3) | 0.12 |
| | | Additive (5) | 0.014 |
| | | Additive (1) | $3.0 \times 10^{-3}$ |
| | | Additive (2) | 0.15 |
| | | High Boiling Point Organic Solvent (2) | 0.07 |
| | | Surface Active Agent (5) | 0.06 |
| | | Gelatin | 0.97 |
| 13th Layer | Green Sensitive Layer (low sensitivity) | Internal Latent Image-Type Direct Positive Emulsion: D | 0.11 as silver |
| | | Internal Latent Image-Type Direct Positive Emulsion: E | 0.08 as silver |
| | | Nucleating agent(1) | $2.7 \times 10^{-6}$ |
| | | Additive (3) | 0.011 |
| | | Additive (4) | 0. 033 |
| | | Additive (5) | $1.5 \times 10^{-3}$ |
| | | Additive (1) | 0.010 |
| | | Surface Active Agent (5) | 0.024 |
| | | Gelatin | 0.26 |
| 12th Layer | Interlayer | Additive (1) | 0.014 |
| | | Surface Active Agent (1) | 0.038 |
| | | Surface Active Agent (3) | $4.0 \times 10^{-3}$ |
| | | Additive (5) | 0.014 |
| | | Gelatin | 0.33 |
| 11th Layer | Magenta Coloring Material Layer | Magenta Dye Releasing Compound(1) | 0.56 |
| | | High Boiling Point Organic Solvent(1) | 0.18 |
| | | Additive (13) | $9.3 \times 10^{-4}$ |
| | | Additive (5) | 0.02 |
| | | Surface Active Agent (4) | 0.04 |
| | | Additive (14) | 0.02 |
| | | Additive (1) | $7.0 \times 10^{-3}$ |
| | | Gelatin | 0.45 |
| 10th Layer | Interlayer | Additive (10) | 0.014 |
| | | Surface Active Agent (1) | $3.0 \times 10^{-4}$ |
| | | Additive (1) | $9.0 \times 10^{-3}$ |
| | | Gelatin | 0.36 |
| 9th Layer | Color Stain Inhibiting Layer | Additive (11) | 0.38 |
| | | High Boiling Point Organic Solvent(2) | 0.19 |
| | | Gelatin | 0.66 |
| | | Surface Active Agent (5) | 0.016 |
| | | Additive (1) | $2.0 \times 10^{-3}$ |
| | | Additive (12) | 0.49 |
| | | Gelatin | 0.65 |
| 8th Layer | Red-Sensitive Layer (high sensitivity) | Internal Latent Image-Type Direct Positive Emulsion: A-1 | 0.33 as silver |
| | | Nucleating Agent(1) | $6.1 \times 10^{-6}$ |
| | | Additive (3) | 0.04 |
| | | Additive (5) | 0.01 |
| | | Additive (1) | $1.0 \times 10^{-3}$ |
| | | Additive (2) | 0.08 |
| | | High Boiling Point Organic Solvent (2) | 0.04 |

-continued

| Layer No. | Layer Name | Additive | Amount Coated ($g/m^2$) |
|---|---|---|---|
| | | Surface Active Agent (5) | 0.02 |
| | | Gelatin | 0.33 |
| 7th Layer | Red-Sensitive Layer (low sensitivity) | Internal Latent Image-Type Direct Positive Emulsion: F | 0.10 as silver |
| | | Internal Latent Image-Type Direct Positive Emulsion: G | 0.11 as silver |
| | | Nucleating agent(1) | $2.5 \times 10^{-5}$ |
| | | Additive (3) | 0.047 |
| | | Additive (5) | 0.016 |
| | | Additive (1) | $8.0 \times 10^{-3}$ |
| | | Surface Active Layer (5) | 0.02 |
| | | Gelatin | 0.57 |
| 6th Layer | White Reflective Layer | Titanium dioxide | 1.87 |
| | | Additive (1) | $7.0 \times 10^{-3}$ |
| | | Surface Active Agent (1) | $4.0 \times 10^{-4}$ |
| | | Additive (5) | 0.02 |
| | | Additive (8) | 0.015 |
| | | Gelatin | 0.73 |
| 5th Layer | Cyan Coloring Material Layer | Cyan Dye Releasing Compound (1) | 0.25 |
| | | Cyan Dye Releasing Compound (2) | 0.14 |
| | | High Boiling Point Organic Solvent (1) | 0.05 |
| | | Additive (3) | 0.06 |
| | | Additive (5) | 0.01 |
| | | Surface Active Agent (4) | 0.05 |
| | | Additive (9) | 0.05 |
| | | Additive (1) | $4.0 \times 10^{-3}$ |
| | | Hardening Agent (3) | 0.014 |
| | | Gelatin | 0.40 |
| 4th Layer | Light-Shielding Layer | Carbon black | 1.50 |
| | | Surface Active Agent (1) | 0.08 |
| | | Additive (1) | 0.06 |
| | | Additive (5) | 0.06 |
| | | Additive (12) | 0.15 |
| | | Gelatin | 1.43 |
| 3rd Layer | Interlayer | Surface Active Agent (1) | $6.0 \times 10^{-4}$ |
| | | Additive (1) | $9.0 \times 10^{-3}$ |
| | | Additive (5) | 0.013 |
| | | Gelatin | 0.29 |
| 2nd Layer | White Reflective Layer | Titanium dioxide | 19.8 |
| | | Additive (15) | 0.378 |
| | | Additive (16) | 0.094 |
| | | Surface Active Agent (6) | 0.019 |
| | | Additive (8) | 0.16 |
| | | Hardening Agent (1) | 0.02 |
| | | Hardening Agent (2) | 0.007 |
| | | Gelatin | 2.45 |
| 1st Layer | Image-Receiving Layer | Polymer Mordanting Agent (1) | 2.22 |
| | | Additive (17) | 0.26 |
| | | Surface Active Agent (7) | 0.04 |
| | | Additive (5) | 0.11 |
| | | Hardening Agent (1) | 0.03 |
| | | Hardening Agent (2) | 0.01 |
| | | Gelatin | 3.25 |
| Support (90 μm-thick polyethylene terephthalate containing titanium dioxide for preventing light piping and subjected to undercoating) | | | |
| Back Layer | Curling controlling Layer | Ultraviolet Absorbent (4) | 0.40 |
| | | Ultraviolet Absorbent (5) | 0.10 |
| | | Diacetyl cellulose (acetylation degree: 51%) | 4.20 |
| | | Additive (18) | 0.25 |
| | | Barium stearate | 0.11 |
| | | Hardening Agent (4) | 0.50 |

TABLE 1

Content of Sensitizing Dye per 1 Kg of Emulsion

| Layer No. | Name of Emulsion | Kind of Sensitizing Dye | Dispersion Form of Dye | Addition Temperature | Dye Amount, g/kg of Emulsion |
|---|---|---|---|---|---|
| 20 | A-1 | (9) | aqueous solution | 70° C. | $9.38 \times 10^{-2}$ |
| | | (8) | aqueous solution | | $1.19 \times 10^{-1}$ |
| 19 | B | (9) | aqueous solution | 60° C. | $6.50 \times 10^{-2}$ |
| | | (8) | aqueous solution | | $1.47 \times 10^{-1}$ |
| 19 | C | (9) | aqueous solution | 60° C. | $7.31 \times 10^{-2}$ |
| | | (8) | aqueous solution | | $1.66 \times 10^{-1}$ |
| 14 | A-1 | (7) | gelatin dispersion | 60° C. | $1.18 \times 10^{-1}$ |
| | | (4) | gelatin dispersion | | $2.94 \times 10^{-3}$ |
| | | (6) | water/organic solvent dispersion by surface active agent | | $9.23 \times 10^{-2}$ |
| 13 | D | (7) | gelatin dispersion | 40° C. | $6.49 \times 10^{-2}$ |
| | | (4) | gelatin dispersion | | $1.62 \times 10^{-3}$ |
| | | (6) | water/organic solvent dispersion by surface active agent | | $4.85 \times 10^{-2}$ |
| 13 | E | (7) | Gelatin dispersion | 40° C. | $7.34 \times 10^{-2}$ |
| | | (4) | Gelatin dispersion | | $1.83 \times 10^{-3}$ |
| | | (6) | water/organic solvent dispersion by surface active agent | | $5.69 \times 10^{-2}$ |
| 8 | A-1 | (5) | aqueous solution | 60° C. | $3.10 \times 10^{-2}$ |
| | | (4) | gelatin dispersion | | $2.26 \times 10^{-2}$ |
| | | (3) | gelatin dispersion | | $2.26 \times 10^{-2}$ |
| | | (2) | gelatin dispersion | | $2.79 \times 10^{-3}$ |
| | | (1) | gelatin dispersion | | $9.20 \times 10^{-2}$ |
| 7 | F | (5) | aqueous solution | 60° C. | $1.63 \times 10^{-2}$ |
| | | (4) | gelatin dispersion | | $1.34 \times 10^{-2}$ |
| | | (3) | gelatin dispersion | | $1.34 \times 10^{-2}$ |
| | | (2) | gelatin dispersion | | $1.91 \times 10^{-3}$ |
| | | (1) | gelatin dispersion | | $6.32 \times 10^{-2}$ |
| 7 | G | (5) | aqueous solution | 50° C. | $1.17 \times 10^{-2}$ |
| | | (4) | gelatin dispersion | | $8.90 \times 10^{-3}$ |
| | | (3) | gelatin dispersion | | $8.90 \times 10^{-3}$ |
| | | (2) | gelatin dispersion | | $1.32 \times 10^{-3}$ |
| | | (1) | gelatin dispersion | | $4.37 \times 10^{-2}$ |

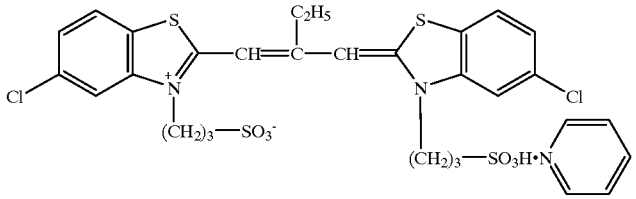

Molecular weight: 728.77
Molecular formula:
$C_{25}H_{26}Cl_2N_2O_6S_4C_5H_5N_1$
Sensitizing Dye (1)

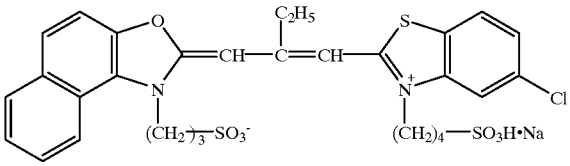

Molecular weight: 686.24
Molecular formula:
$C_{30}H_{31}Cl_1N_2O_7S_3NA_1$
Sensitizing Dye (3)

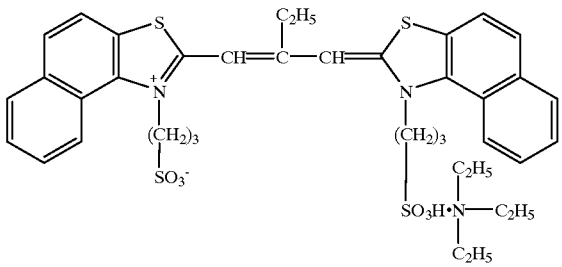

Molecular weight: 782.09
Molecular formula:
$C_{33}H_{32}N_2O_6S_4C_6H_{15}N_1$
Sensitizing Dye (2)

TABLE 1-continued

| Content of Sensitizing Dye per 1 Kg of Emulsion | |
|---|---|
| 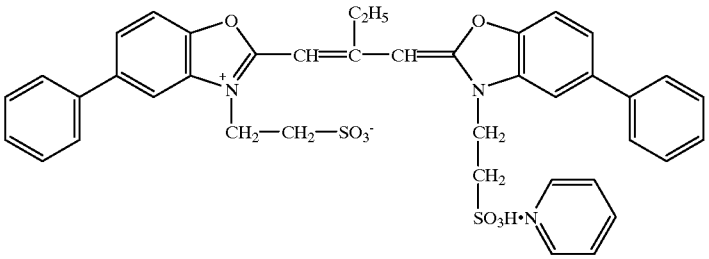 | Molecular weight: 751.89<br>Molecular formula:<br>$C_{35}H_{32}N_2O_8S_2C_5H_5N_1$<br>Sensitizing Dye (7) |
| 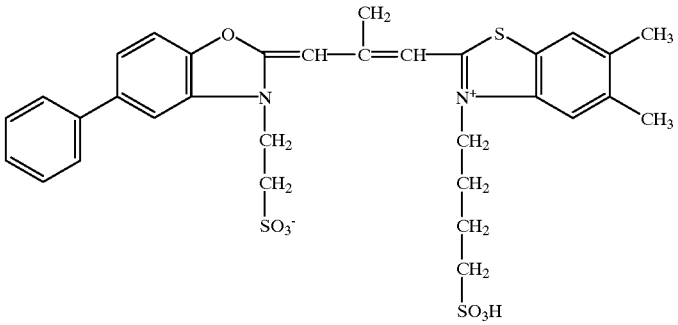 | Molecular weight: 707.96<br>Molecular formula:<br>$C_{33}H_{36}N_2O_7S_3K_1$<br>Sensitizing Dye (4) |
| 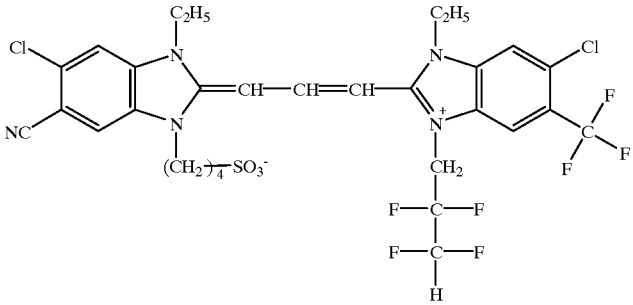 | Molecular weight: 742.57<br>Molecular formula:<br>$C_{30}H_{28}C_{12}F_7N_5O_3S_1$<br>Sensitizing Dye (6) |
| 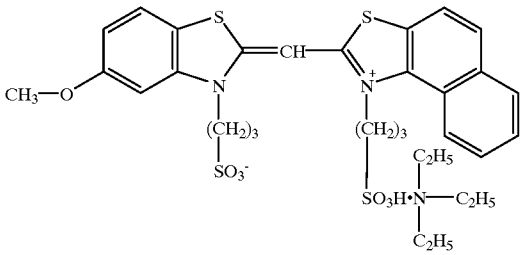 | Molecular weight: 707.96<br>Molecular formula:<br>$C_{26}H_{26}N_2O_7S_4C_6H_5N_1$<br>Sensitizing Dye (9) |
| 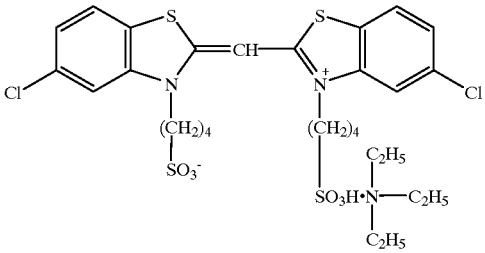 | Molecular weight: 724.83<br>Molecular formula:<br>$C_{23}H_{24}Cl_2N_2O_6S_4C_6H_{15}N_1$<br>Sensitizing Dye (5) |

TABLE 1-continued
| Content of Sensitizing Dye per 1 Kg of Emulsion | |
|---|---|
| 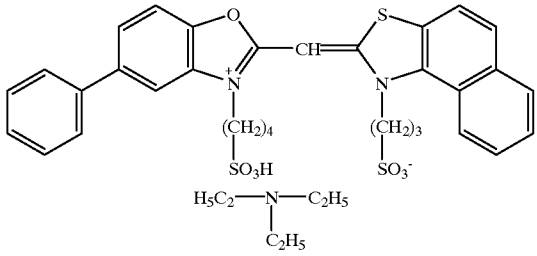 | Molecular weight: 752.00<br>Molecular formula:<br>$C_{32}H_{30}N_2O_7S_3C_6H_{15}N_1$<br>Sensitizing Dye (8) |
Yellow Dye Releasing Compound (1)
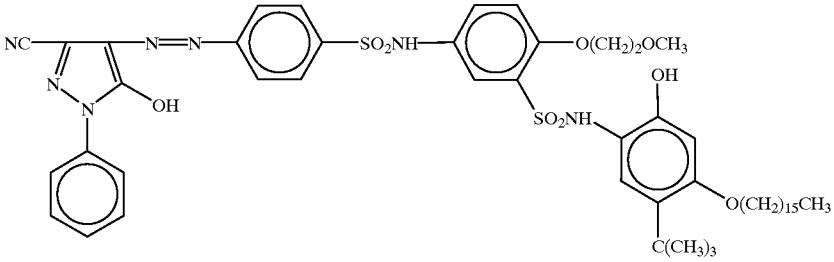
Magenta Dye Releasing Compound (1)
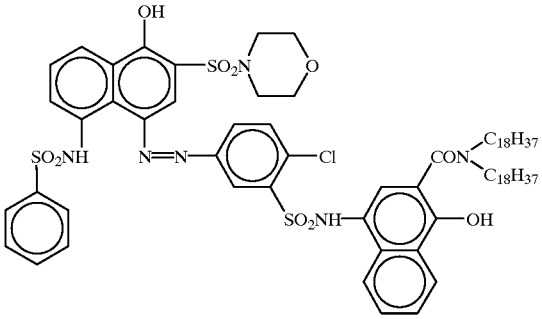
Cyan Dye Releasing Compound (1)
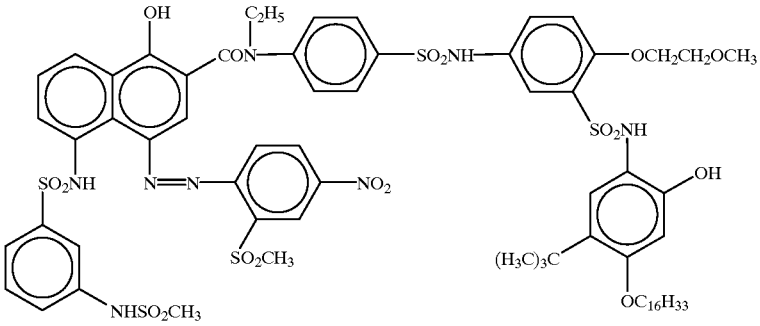

Cyan Dye Releasing Compound (2)
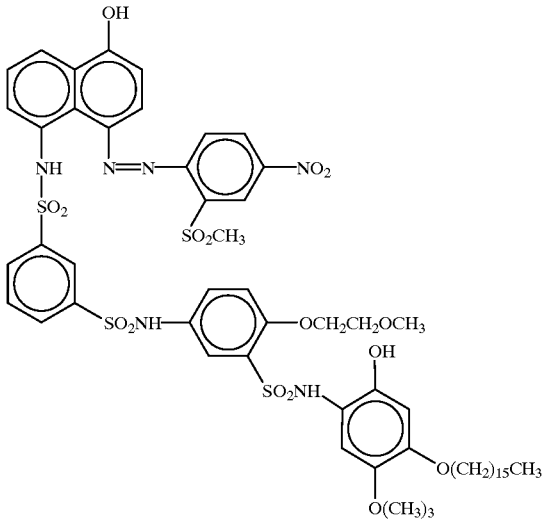
Additive (1)
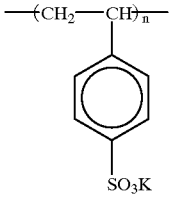
Additive (2)
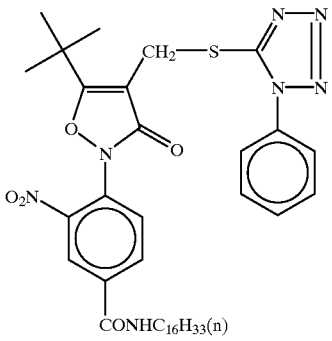
Additive (3)
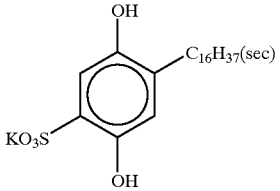
Additive (4)
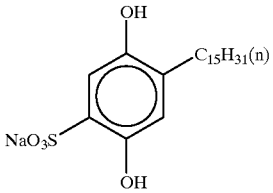
Additive (5)
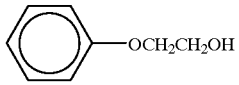
Additive (6)
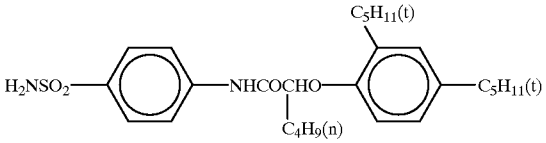
Additive (7)
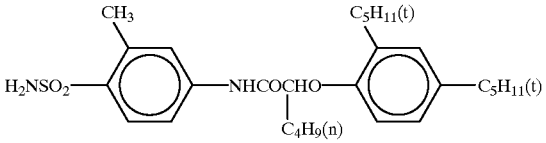
Additive (8)
Carboxymethyl cellulose
(CMC CELLOGEN 6A, produced by Daiichi Kogyo Seiyaku K.K.)
Additive (9)
Polyvinyl alcohol (PVA-220E)
Polymerization degree: about 2,000, saponification degree: 88%
Additive (10)
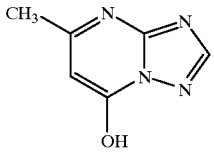
Additive (11)
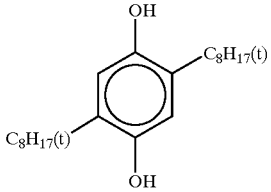

Additive (12)
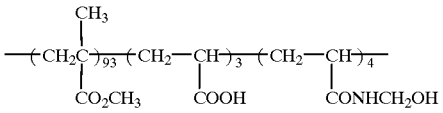
Additive (13)
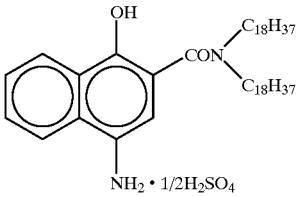
Additive (14)
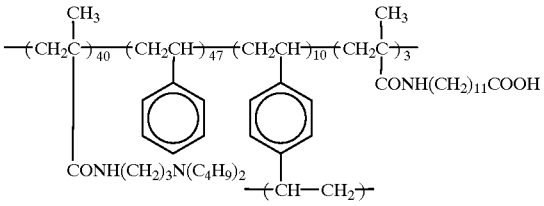
Additive (15)
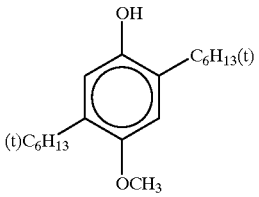
Additive (16)
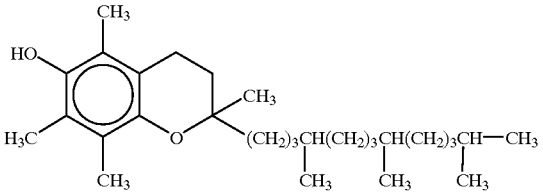
Additive (17)
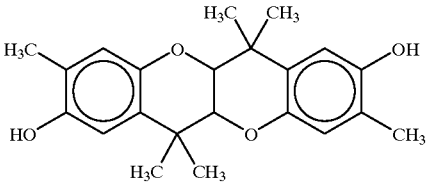
Additive (18)
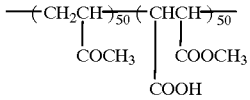
Matting Agent (1)
Polymethyl methacrylate spherical latex (average particle size: 3 $\mu$m)
Surface Active Agent (1)
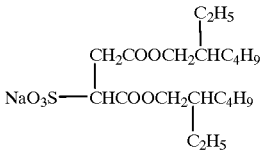
Surface Active Agent (2)
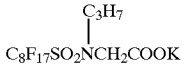
Surface Active Agent (3)
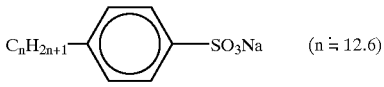
Surface Active Agent (4)
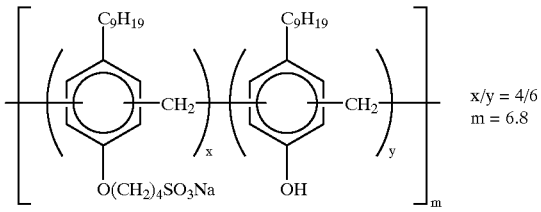
Surface Active Agent (5)
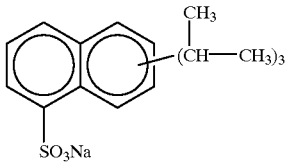
Surface Active Agent (6)
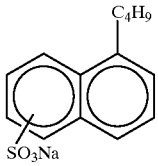

Surface Active Agent (7)

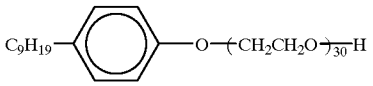

Ultraviolet Absorbent (1)

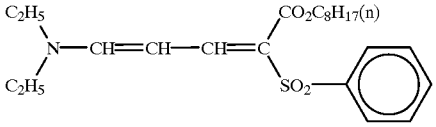

Ultraviolet Absorbent (2)

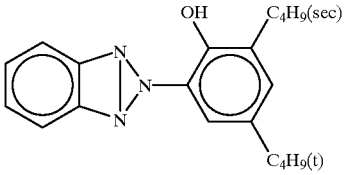

Ultraviolet Absorbent (3)

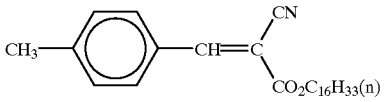

High Boiling Point Organic Solvent (1)

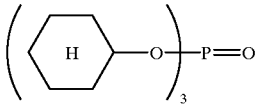

High Boiling Point Organic Solvent (2)

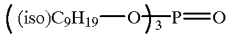

Ultraviolet Absorbent (4)

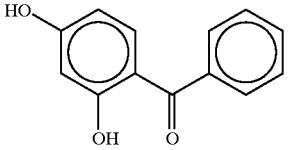

Ultraviolet Absorbent (5)

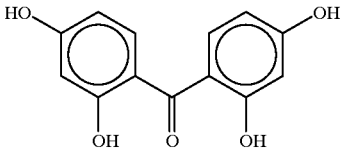

Hardening Agent (1)

$CH_2{=}CHSO_2CH_2CONH(CH_2)_2NHCOCH_2SO_2CH{=}CH_2$

Hardening Agent (2)

$CH_2{=}CHSO_2CH_2CONH(CH_2)_3NHCOCH_2SO_2CH{=}CH_2$

Hardening Agent (3)

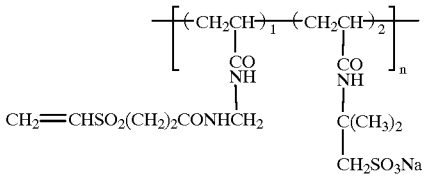

Hardening Agent (4)

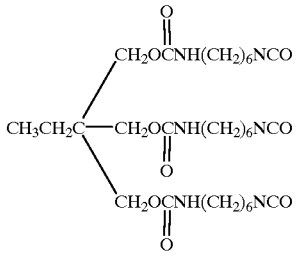

Nucleating Agent (1)

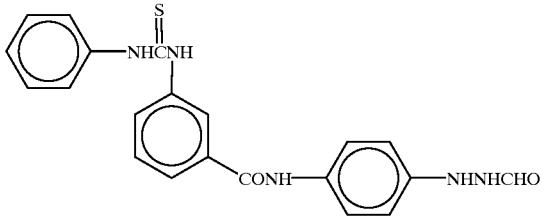

Polymer Mordanting Agent (1)

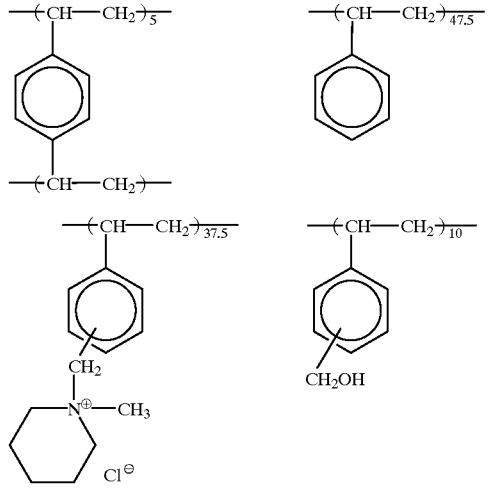

Samples 102 to 108 and 201 to 208 were prepared using one of Emulsions A-2 to A-8 and T-1 to T-8 in place of the emulsions of the 8th layer, the 14th layer and the 20th layer, as shown in Table 2 below.

TABLE 2

| Sample No. | List of Emulsions Used 8th Layer | 14th Layer | 20th Layer |
|---|---|---|---|
| 101 (Comparison) | A-1 | A-1 | A-1 |
| 102 (Comparison) | A-2 | A-2 | A-2 |
| 103 (Invention) | A-3 | A-3 | A-3 |
| 104 (Invention) | A-4 | A-4 | A-4 |
| 105 (Comparison) | A-5 | A-5 | A-5 |
| 106 (Invention) | A-6 | A-6 | A-6 |
| 107 (Invention) | A-7 | A-7 | A-7 |
| 108 (Invention) | A-8 | A-8 | A-8 |
| 201 (Comparison) | T-1 | T-1 | T-1 |
| 202 (Comparison) | T-2 | T-2 | T-2 |
| 203 (Invention) | T-3 | T-3 | T-3 |
| 204 (Invention) | T-4 | T-4 | T-4 |
| 205 (Comparison) | T-5 | T-5 | T-5 |
| 206 (Invention) | T-6 | T-6 | T-6 |
| 207 (Invention) | T-7 | T-7 | T-7 |
| 208 (Invention) | T-8 | T-8 | T-8 |
| 301 (Comparison) | T-1 | T-1 | U-1 |
| 302 (Comparison) | T-1 | T-1 | U-2 |
| 303 (Invention) | T-1 | T-1 | U-3 |
| 304 (Invention) | T-1 | T-1 | U-4 |
| 305 (Comparison) | T-1 | T-1 | U-5 |
| 306 (Invention) | T-1 | T-1 | U-6 |
| 307 (Invention) | T-1 | T-1 | U-7 |
| 308 (Invention) | T-1 | T-1 | U-8 |

The cover sheet was formed as follows.

The following layers were coated on a polyethylene terephthalate support containing a dye for preventing light piping and having a gelatin undercoat:

(a) a neutralizing layer containing 10.4 g/m$^2$ of an acrylic acid/n-butyl acrylate copolymer (80/20 (mol %)) having an average molecular weight of 50,000 and 0.1 g/m$^2$ of 1,4-bis(2,3-epoxypropoxy)-butane;

(b) a layer containing 4.3 g/m$^2$ of cellulose acetate having an acetylation degree of 55% and 0.2 g/m$^2$ of methyl half ester of a methyl vinyl ether/maleic acid anhydride copolymer (50/50 (mol %)); and (c) a neutralization timing layer containing 0.3 g/m$^2$ of a n-butyl methacrylate/2-hydroxyethyl methacrylate/acrylic acid copolymer (66.1/28.4/5.5 (wt %)) having an average molecular weight of 25,000 and 0.8 g/m$^2$ of an ethyl methacrylate having an average molecular weight of 40,000/2-hydroxyethyl methacrylate/acrylic acid copolymer (66.1/28.4/5.5 (wt %)).

As the dye for preventing light piping, a 3:1 mixture of KAYASET GREEN A-G produced by Nippon Kayaku K.K. and the compound shown below was used.

Dye for Preventing Light Piping

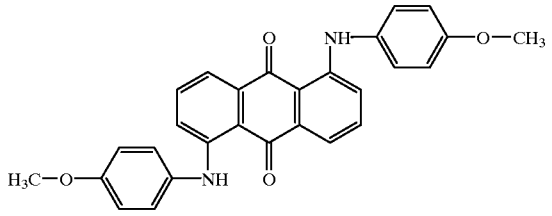

The alkali processing composition was prepared by the following method.

0.8 g of the processing solution having the following composition was filled in a container capable of rupturing by a pressure.

| | |
|---|---|
| Water | 695 g |
| 1-p-Tolyl-4-hydroxymethyl-4-methyl-3-pyrazolidin-4-one | 7.00 g |
| 1-Phenyl-4-hydroxymethyl-4-methyl-3-pyrazolidin-1-one | 9.85 g |
| Sulfinic acid polymer | 2.10 g |
| 5-Methylbenzotriazole | 2.50 g |
| Zinc nitrate hexahydrate | 0.60 g |
| Potassium sulfite | 1.90 g |
| Aluminum nitrate nonahydrate | 0.60 g |
| Carboxymethyl cellulose Na salt | 56.0 g |
| Potassium hydroxide | 55.0 g |
| Carbon black | 160 g |
| Anionic surface active agent (1) | 8.60 g |
| Anionic surface active agent (2) | 0.03 g |
| Alkyl-modified PVA (produced by Kuraray) | 0.06 g |
| Cationic polymer | 1.05 g |

Sulfinic Acid Polymer

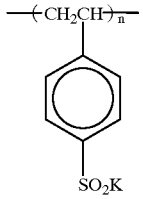

Anionic Surface Active Agent (1)

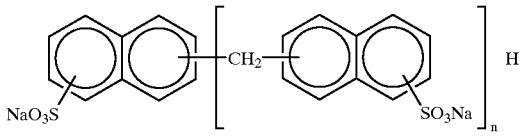

Anionic Surface Active Agent (2)

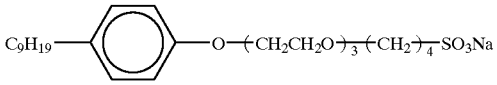

Alkyl-modified PVA

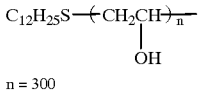

Cationic Polymer

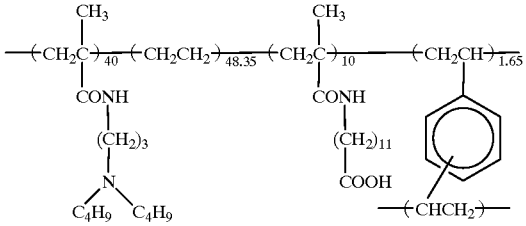

Light-Sensitive Elements 101 to 108 and 201 to 208 prepared above each was exposed through a continuous wedge from the emulsion layer side and superposed on the cover sheet prepared above, and the processing solution shown above was spread between these two materials using a pressure roller to have a thickness of 62 μm. The exposure was performed for 1/100 second by controlling the exposure illuminance to give a constant exposure amount. The processing was performed at 15° C. or 25° C. and 10 minutes after the processing, the transfer density was measured by a color densitometer.

The results obtained are shown in Tables 3 to 6. The maximum density, the minimum density, the midpoint sensitivity and the foot sensitivity in the Tables were determined as follows. A characteristic curve was drawn such that the abscissa was the logarithm of the exposure amount and the ordinate was the color density. The color density in the non-exposed area was defined as the maximum density, the color density in the region having a sufficiently large exposure amount was defined as the minimum density, the sensitivity giving a medium density between the maximum density and the minimum density was defined as the midpoint sensitivity, and the sensitivity of giving a density of 0.3 was defined as the foot density. The sensitivity of Sample 101 was assumed to be 100.

TABLE 3

Maximum Density, Minimum Density, Midpoint Sensitivity and Foot Sensitivity at −25° C.

| | Maximum Density | | | Minimum Density | | | Midpoint Sensitivity | | | Foot Sensitivity | | |
|---|---|---|---|---|---|---|---|---|---|---|---|---|
| Sample No. | Y | M | C | Y | M | C | Y | M | C | Y | M | C |
| 101 (Comparison) | 2.10 | 2.30 | 2.40 | 0.17 | 0.16 | 0.24 | 100 | 100 | 100 | 100 | 100 | 100 |
| 102 (Comparison) | 1.90 | 2.10 | 2.22 | 0.19 | 0.18 | 0.27 | 85 | 87 | 88 | 84 | 85 | 86 |
| 103 (Invention) | 2.03 | 2.20 | 2.30 | 0.18 | 0.17 | 0.25 | 101 | 101 | 101 | 106 | 107 | 108 |
| 104 (Invention) | 2.05 | 2.24 | 2.35 | 0.17 | 0.16 | 0.24 | 104 | 105 | 104 | 111 | 112 | 113 |
| 105 (Comparison) | 2.00 | 2.20 | 2.32 | 0.19 | 0.19 | 0.26 | 107 | 106 | 106 | 92 | 91 | 92 |
| 106 (Invention) | 2.08 | 2.30 | 2.39 | 0.17 | 0.16 | 0.24 | 131 | 130 | 130 | 132 | 130 | 129 |
| 107 (Invention) | 2.10 | 2.30 | 2.40 | 0.17 | 0.16 | 0.24 | 128 | 129 | 126 | 125 | 127 | 126 |
| 108 (Invention) | 2.08 | 2.30 | 2.38 | 0.17 | 0.16 | 0.24 | 123 | 121 | 122 | 123 | 124 | 124 |
| 201 (Comparison) | 2.12 | 2.32 | 2.42 | 0.17 | 0.16 | 0.24 | 103 | 106 | 107 | 103 | 105 | 106 |
| 202 (Comparison) | 1.80 | 2.04 | 2.12 | 0.20 | 0.19 | 0.28 | 92 | 97 | 97 | 93 | 96 | 96 |
| 203 (Invention) | 2.07 | 2.24 | 2.33 | 0.19 | 0.18 | 0.26 | 111 | 113 | 114 | 108 | 110 | 111 |
| 204 (Invention) | 2.10 | 2.30 | 2.40 | 0.18 | 0.17 | 0.25 | 122 | 124 | 125 | 125 | 128 | 127 |
| 205 (Comparison) | 1.90 | 2.07 | 2.20 | 0.21 | 0.20 | 0.33 | 108 | 111 | 112 | 88 | 86 | 89 |
| 206 (Invention) | 2.13 | 2.33 | 2.43 | 0.17 | 0.16 | 0.24 | 152 | 148 | 149 | 162 | 158 | 156 |
| 207 (Invention) | 2.12 | 2.34 | 2.42 | 0.17 | 0.16 | 0.24 | 141 | 140 | 139 | 151 | 140 | 139 |
| 208 (Invention) | 2.13 | 2.33 | 2.44 | 0.17 | 0.16 | 0.24 | 148 | 144 | 146 | 158 | 156 | 156 |

TABLE 4

Maximum Density, Minimum Density, Midpoint Sensitivity and Foot Sensitivity at −25° C.

| | Maximum Density | | | Minimum Density | | | Midpoint Sensitivity | | | Foot Sensitivity | | |
|---|---|---|---|---|---|---|---|---|---|---|---|---|
| Sample No. | Y | M | C | Y | M | C | Y | M | C | Y | M | C |
| 301 (Comparison) | 2.02 | 2.32 | 2.42 | 0.20 | 0.16 | 0.24 | 150 | 106 | 107 | 145 | 105 | 106 |
| 302 (Comparison) | 1.74 | 2.30 | 2.40 | 0.25 | 0.17 | 0.25 | 158 | 107 | 108 | 132 | 106 | 107 |
| 303 (Invention) | 1.96 | 2.32 | 2.42 | 0.19 | 0.16 | 0.24 | 162 | 106 | 107 | 155 | 105 | 106 |
| 304 (Invention) | 2.08 | 2.32 | 2.42 | 0.18 | 0.16 | 0.24 | 171 | 106 | 107 | 163 | 105 | 106 |
| 305 (Comparison) | 1.86 | 2.31 | 2.41 | 0.21 | 0.17 | 0.26 | 153 | 107 | 108 | 136 | 106 | 107 |
| 306 (Invention) | 2.12 | 2.32 | 2.42 | 0.17 | 0.16 | 0.24 | 201 | 106 | 107 | 208 | 105 | 106 |
| 307 (Invention) | 2.11 | 2.32 | 2.42 | 0.17 | 0.16 | 0.24 | 195 | 106 | 107 | 198 | 105 | 106 |
| 308 (Invention) | 2.12 | 2.32 | 2.42 | 0.17 | 0.16 | 0.24 | 198 | 106 | 107 | 204 | 105 | 106 |

TABLE 5

Difference between 15° C. and 25° C.: Maximum Density, Minimum Density, Midpoint Sensitivity, Foot Sensitivity

| | Difference Δ of Maximum Density (15° C.–25° C.) | | | Difference Δ of Minimum Density (15° C.–25° C.) | | | Difference Δ of Midpoint Sensitivity (15° C.–25° C.) | | | Difference Δ of Foot Sensitivity (15° C.–25° C.) | | |
|---|---|---|---|---|---|---|---|---|---|---|---|---|
| Sample No. | Y | M | C | Y | M | C | Y | M | C | Y | M | C |
| 101 (Comparison) | −0.15 | −0.15 | −0.20 | −0.02 | −0.02 | −0.02 | +12 | +14 | +14 | +18 | +19 | +20 |
| 102 (Comparison) | −0.12 | −0.25 | −0.32 | −0.02 | −0.02 | −0.02 | +16 | +18 | +20 | +20 | +25 | +30 |
| 103 (Invention) | −0.09 | −0.16 | −0.16 | −0.01 | −0.01 | −0.01 | +6 | +6 | +6 | +6 | +6 | +5 |
| 104 (Invention) | −0.05 | −0.10 | −0.09 | −0.01 | −0.01 | −0.01 | +3 | +4 | +3 | +3 | +3 | +3 |
| 105 (Comparison) | −0.12 | −0.18 | −0.19 | −0.01 | −0.02 | −0.02 | +7 | +9 | +8 | +9 | +8 | +8 |
| 106 (Invention) | −0.02 | −0.02 | −0.03 | ±0 | ±0 | ±0 | +1 | +2 | ±0 | ±0 | ±0 | ±0 |

TABLE 5-continued

Difference between 15° C. and 25° C.: Maximum Density, Minimum Density, Midpoint Sensitivity, Foot Sensitivity

| Sample No. | Difference Δ of Maximum Density (15° C.–25° C.) | | | Difference Δ of Minimum Density (15° C.–25° C.) | | | Difference Δ of Midpoint Sensitivity (15° C.–25° C.) | | | Difference Δ of Foot Sensitivity (15° C.–25° C.) | | |
|---|---|---|---|---|---|---|---|---|---|---|---|---|
| | Y | M | C | Y | M | C | Y | M | C | Y | M | C |
| 107 (Invention) | −0.01 | −0.04 | −0.02 | ±0 | ±0 | ±0 | 0 | +1 | ±0 | ±0 | ±0 | ±0 |
| 108 (Invention) | −0.01 | −0.03 | −0.02 | ±0 | ±0 | ±0 | +1 | ±0 | ±0 | ±0 | ±0 | ±0 |
| 201 (Comparison) | −0.18 | −0.29 | −0.28 | −0.03 | −0.03 | −0.03 | +17 | +18 | +18 | +25 | +28 | +30 |
| 202 (Comparison) | −0.20 | −0.21 | −0.20 | −0.02 | −0.03 | −0.02 | +20 | +21 | +23 | +31 | +35 | +37 |
| 203 (Invention) | −0.08 | −0.07 | −0.09 | −0.01 | −0.01 | −0.01 | +8 | +8 | +7 | +7 | +8 | +7 |
| 204 (Invention) | −0.03 | −0.04 | −0.03 | −0.01 | −0.01 | −0.01 | +4 | +3 | +3 | +2 | +3 | +2 |
| 205 (Comparison) | −0.10 | −0.08 | −0.11 | −0.02 | −0.02 | −0.03 | +11 | +12 | +11 | +8 | +10 | +9 |
| 206 (Invention) | −0.01 | −0.01 | −0.02 | ±0 | ±0 | ±0 | +1 | ±0 | ±0 | ±0 | ±0 | ±0 |
| 207 (Invention) | −0.02 | −0.01 | ±0 | ±0 | ±0 | ±0 | ±0 | +1 | +1 | ±0 | ±0 | ±0 |
| 208 (Invention) | −0.03 | ±0 | −0.01 | ±0 | ±0 | ±0 | ±0 | ±0 | +1 | ±0 | ±0 | ±0 |

TABLE 6

Difference between 15° C. and 25° C.: Maximum Density, Minimum Density, Midpoint Sensitivity, Foot Sensitivity

| Sample No. | Difference Δ of Maximum Density (15° C.–25° C.) | | | Difference Δ of Minimum Density (15° C.–25° C.) | | | Difference Δ of Midpoint Sensitivity (15° C.–25° C.) | | | Difference Δ of Foot Sensitivity (15° C.–25° C.) | | |
|---|---|---|---|---|---|---|---|---|---|---|---|---|
| | Y | M | C | Y | M | C | Y | M | C | Y | M | C |
| 301 (Comparison) | −0.35 | −0.29 | −0.28 | −0.05 | −0.03 | −0.03 | +33 | +18 | +18 | +38 | +28 | +30 |
| 302 (Comparison) | −0.38 | −0.30 | −0.29 | −0.07 | −0.04 | −0.04 | +41 | +19 | +19 | +42 | +29 | +31 |
| 303 (Invention) | −0.14 | −0.29 | −0.28 | −0.03 | −0.03 | −0.03 | +16 | +18 | +18 | +21 | +28 | +30 |
| 304 (Invention) | −0.08 | −0.29 | −0.28 | −0.01 | −0.03 | −0.03 | +8 | +18 | +18 | +13 | +28 | +30 |
| 305 (Comparison) | −0.26 | −0.30 | −0.29 | −0.04 | −0.04 | −0.03 | +25 | +20 | +19 | +28 | +30 | +32 |
| 306 (Invention) | −0.02 | −0.29 | −0.28 | ±0 | −0.03 | −0.03 | +4 | +18 | +18 | +6 | +28 | +30 |
| 307 (Invention) | −0.02 | −0.29 | −0.28 | ±0 | −0.03 | −0.03 | +5 | +18 | +18 | +7 | +28 | +30 |
| 308 (Invention) | −0.03 | −0.29 | −0.28 | ±0 | −0.03 | −0.03 | +4 | +18 | +18 | +7 | +28 | +30 |

It is seen that Sample 106 of the present invention was increased both in the midpoint sensitivity and the foot sensitivity as compared with Sample 101. Furthermore, it is apparent that the problem encountered in Sample 201 that the density was reduced in the processing at 15° C., was improved in Sample 206 where the density scarcely decreased at 15° C. and dependency of the density and the sensitivity on the processing temperature was low.

According to the present invention, an internal latent image-type direct positive silver halide emulsion having high sensitivity and reduced in the change of the image due to the processing temperature is provided. Also, a color diffusion transfer photographic light-sensitive material using the emulsion is provided.

While the invention has been described in detail and with reference to specific embodiments thereof, it will be apparent to one skilled in the art that various changes and modification can be made therein without departing from the spirit and scope thereof.

What is claimed is:

1. An internal latent image-type direct positive silver halide photographic emulsion, comprising a silver halide grain prepared to have a composite structure such that the iodide content of the silver halide in the silver halide phase formed on the surface of a silver halide grain is higher than the iodide content of the silver halide in the phase on the inner side, wherein the average iodide content of all grains is less than 1.0 mol % and the amount of iodide supplied for the silver halide phase formed on the surface of the grain is from 0.005 mol % to less than 0.3 mol % based on all grains.

2. The internal latent image-type direct positive silver halide photographic emulsion as claimed in claim 1, wherein the iodide for the silver halide phase formed on the surface of the grain is supplied by the simultaneous addition of a silver nitrate solution and an iodide ion-containing solution or by the addition of fine grain silver halide comprising silver iodide and/or silver iodobromide.

3. The internal latent image-type direct positive silver halide photographic emulsion as claimed in claim 1 or 2, wherein 50% or more of all silver halide grains are occupied by silver halide tabular grains which are the silver halide grain having a composite structure and which have an average grain diameter of 0.3 μm or more and a ratio of average grain diameter/average grain thickness of 2 or more.

* * * * *